US006125661A

United States Patent [19]

Shima

[11] Patent Number: 6,125,661

[45] Date of Patent: Oct. 3, 2000

[54] FLAT KNITTING MACHINE

[75] Inventor: Masahiro Shima, Wakayama, Japan

[73] Assignee: Shima Seiki Manufacturing Limited, Wakayama, Japan

[21] Appl. No.: 09/304,344

[22] Filed: May 4, 1999

[30] Foreign Application Priority Data

May 6, 1998 [JP] Japan ..... 10-123786
May 19, 1998 [JP] Japan ..... 10-142594

[51] Int. Cl.[7] ..... D04B 7/04

[52] U.S. Cl. ..... 66/64; 66/78

[58] Field of Search ..... 66/60 R, 62, 64, 66/67, 68, 70, 71, 72, 73, 74, 75.1, 76, 77, 78, 116, 120, 123

[56] References Cited

U.S. PATENT DOCUMENTS 4,474,037 10/1984 Kuhnert ..... 66/78
4,637,227 1/1987 Shima ..... 66/78
4,637,228 1/1987 Shima ..... 66/78
5,343,719 9/1994 Nakamori et al. ..... 66/78
5,367,892 11/1994 Shima et al. ..... 66/78

FOREIGN PATENT DOCUMENTS 0449549 10/1991 European Pat. Off. ..... 66/78
2143855 2/1985 United Kingdom ..... 66/78

*Primary Examiner*—Danny Worrell
*Attorney, Agent, or Firm*—Arent Fox Kintner Plotkin & Kahn PLLC

[57] ABSTRACT

A flat knitting machine is provided with a guiding mechanism to engage the first butt of the slider of a needle for split knit and a split knit cam provided in the slider cam lock. When the first butt of the slider and the split knit cam is in engagement with each other, the needle proper is cleared. With this arrangement, the slider does not move inadvertently, and the second butt of the slider is reliably guided to the split knit bypass groove, and split knit is completed by the subsequent cam lock.

5 Claims, 23 Drawing Sheets

FLAT KNITTING MACHINE

FIELD OF THE INVENTION

The present invention relates to a flat knitting machine for increasing stitch loops in number (hereinafter referred to as "split knit") by means of compound needles having a needle proper and a slider.

PRIOR ART

The present inventor previously proposed widening by means of a flat knitting machine, so-called split knit (Japanese Provisional Patent Hei 9-202462, EP 890 667 A2). The flat knitting machine uses compound needles (hereinafter referred to as "needles"). Each compound needle is provided with a slider, and the slider has two blades overlapped with each other, said blade being a thin plate and having a tongue formed at the tip thereof. A hook of a needle proper is slidably held between said blades, and the hook can be opened or closed by said tongues. These compound needles are arranged in parallel to each other on each needle bed. The tips of the compound needles of one needle bed are opposed to those of another needle bed.

According to this proposal, split knit is not limited to those between sets of needles of opposing needle beds. If a bed on which members such as transfer jacks or latch needles are mounted is provided over a needle bed, split knit can be made between the needles and these members.

This split knit uses two cam locks that are continuous to each other. First, a leading cam lock makes a needle holding an old stitch loop advance to a knit position then retract, makes the hook of the needle catch yarn being fed by a yarn feeder and pull yarn into the old stitch loop. At the time of retraction of this needle, to prevent the old stitch loop from being knocked over beyond the top end of the slider, the leading cam lock makes the slider keep its position on the trick gap, then the leading cam lock transfers control to the trailing cam lock. The trailing cam lock makes a hook of a needle of the opposing needle bed advance into the old stitch loop held on the tongues of the slider, next the trailing cam lock makes said slider holding the old stitch loop retract. As a result, the old stitch loop will be transferred to the hook of the needle of said opposing needle bed, and a new stitch loop and the old stitch loop will be held on needles of the opposing needle beds.

Split knit will be described with reference to FIG. 14 through FIG. 29. In a flat knitting machine, needles are arranged on a pair of needle beds F, B being arranged to oppose to each other, one in the front and the other in the rear, with a trick gap between them. FIG. 14 shows a carriage that reciprocates over the needle beds to advance and retract needles arranged on the needle beds, in particular, routes of respective butts of needle propers and sliders and select jacks in split knit. FIG. 15 is a perspective view of respective parts constituting a needle. FIG. 16 is a sectional view of the head portion of a needle bed on which needles that are made to advance and retract by said cam lock are arranged. FIG. 16-*a* shows a state when butts of a needle are not subject to pressing actions of pressers that will be described later and are protruding from the needle groove. FIG. 16-*b* shows a state when butts of the needle are subject to pressing actions of pressers and are sunk into the needle grooves. FIG. 17 through FIG. 25 show movements of the needles of the front and rear needle beds in the respective positions 1 through 11 of FIG. 14 in split knit.

A needle 101 has a needle proper 103 and a slider 105. The slider 105 has a slider proper 107 and blades 109*a*, 109*b* being two elastic plates being overlapped with each other. The needle proper 103 has a recess 113 near its tail. The tip of a needle jack 111 is fit into the recess 113. A slider groove 117 is formed in the needle proper 103 from the throat of a hook root 115*a* of the tip of the needle proper towards the center of the needle proper 103. The slider proper 107 has a part that protrudes downward a little ahead of the center thereof, and said protruding part has a blade retainer 121 having a receiving groove 122 and a recess 124.

Blades 109*a*, 109*b* are almost identical in shape to each other. Blades 109*a*, 109*b* have, near the center thereof and on the upper side, a protrusion 130 that fits into the recess 124 that is formed in the blade retainer 121 of the slider proper 107. Said protrusions 130 are fit into said recess 124 to hold the blades 109*a*, 109*b*. Tongues 110*a*, 110*b* are formed at the top ends of the blades 109*a*, 109*b*, respectively.

The needle jack 111 is provided with an elastic foot 112 that extends backward. This elastic foot 112 is formed to be flexible and its rear end contacts the bottom of a needle groove to energize a butt 114 that is formed on the upper edge of the needle jack 111 so that the butt 114 extrudes out of the needle groove. The upward energization by this elastic foot 112 also makes the butts 119, 128 of the slider 105 and the select jack 126, respectively, protrude out of the needle groove. The slider 105 and the select jack 126 are held above the needle jack 111. The needle proper 103 and the needle jack 111 may be formed as one body. Here the butt 114 of the needle jack 111 is called a butt of the needle proper 103. 123 of FIG. 16 denotes a needle bed base. Needle plates 125 are inserted into a large number of grooves cut in this base 123 to form needle grooves 127 between these needle plates 125. 129 denotes a metal plate that prevents needles from coming off.

Each of the front and rear carriages 131F, 131B is provided with two cam locks 133, 133. The cams of of the front carriage and the cams of the rear carriage are symmetrical to each other with respect to the trick gap. The cam lock 133 has a needle proper cam lock 135 for advancing and retracting the needle proper butt 114 of the needle 101 and a slider cam lock 137 for advancing and retracting the slider butt 119. The cam lock 135 has a raising cam 141 for advancing the needle proper 103 to the knit position in the center thereof, stitch cams 143*l*, 143*r* on both sides of the raising cam 141, and a bridge cam 145 in the front of the raising cam 141. Routes for guiding the needle proper butt 114 are formed between these cams. A presser 145 comprising a B(welt)-presser 147, H-presser 148, A(split knit)-presser 149 is provided in the rear of the raising cam 141. Of these pressers, both the H-presser 148 and the split knit presser 149 are held in such a way that they can be controlled to be in or out of the carriage base 151. The pressing lengths of the B-presser 147 and the H-presser 148 are full. The pressing length of the split knit presser 149 is about one half of the pressing lengths of the pressers 147, 148.

In the present specification, expressions such as full, half and zero heights are used in expressing heights of cams and pressers and states of butts. These expressions are defined as follows: In relation to a butt, full height indicates a state when the butt is not subject to a pressing action of a presser, half height indicates a state when the butt is subject to a pressing action of a presser of half height, and zero height indicates a state when the butt is subject to a pressing action of a presser of full height. In relation to a cam, a cam of half height engages with a butt of full height, and a cam of full height engages with a butt of half height and a butt of full height. A cam surface of zero height means a height that a butt of full height can pass by.

The slider cam lock 137 is provided with a center guide groove 153 for guiding the slider butt 119. Each center guide groove 153 is provided with a guide surface 157 in the rear of the center guide groove and close to the bridge cam 145. The center guide groove 153 and the guide surface 157 are connected by a connecting route 155, and the guide surface 157 is parallel to the center guide groove 153.

The above center groove guide 153 is the deepest. It is at the same height (zero height) of the face of the carriage base 151 on which the cam lock 133 is mounted. The guide surface 157 is at the half height, and the surface of the slider cam 132 is at the full height. As the guide surface 157 must be lowered near both side ends to the same height of the carriage base 151, slopes 161, 163 are provided on the left and on the right, respectively. The center guide grooves 153, 153 are connected by first bypass grooves 165, 165 having the half height. A second bypass groove 167 is formed to connect to the tops of the center guide grooves 153, 153. A slope 169 is a slope that connects the zero height and the full height. The second bypass groove 167 is formed to have the zero height between two slopes 169, 169, and the remaining portions have the half height.

FIG. 28 shows a fabric knitted on the above flat knitting machine. Its knitting width is gradually increased (internal widening) by split knit. Steps A through F of FIG. 29 show steps of course knitting at the left edge of the fabric. Step A shows the state of holding of stitch loops on the needle beds F, B just before split knit, and old stitch loops 170 of the previous course are all held on needles b through z of the front needle bed F. In step B, yarn is fed to needles b through z to form new stitch loops 173 of the next course, and a stitch loop 170*b* is split-knitted on the needle f of the rear needle bed B. In step C, the new stitch loops 173 being held on needles b through e of the front needle bed F are transferred onto needles b through e of the rear needle bed B. In step D, the rear needle bed B is racked to the left. In step E, the above transferred new stitch loops 173 and the old stitch loop 170*b* that has been transferred onto the needle of the rear needle bed B by split knit are transferred onto needles a through e of the front needle bed F. The knitting width is gradually increased by repeating similar knitting steps.

Next, cam operation and movements of needles of the front and rear needle beds in a split knit course will be described. FIG. 17 shows the state of needles before arrival of the carriages, and the respective needles of the front and rear needle beds are in their retracted positions (initial positions). With the arrival of the selection systems (not illustrated) of the carriages, on the front needle bed, the select jack butt 128 of a needle that is to make split knit is moved from the initial position or position B and set in the position A by a selector (not illustrated), and select jack butts 128 of other needles that are to make knit are set in the position H. As for the leading cam lock 133, operation of the respective needles is done by only the front carriage F, and the needle for split knit and the needles for knit follow the same advancement/retraction route up to the position 5 that will be described later.

At the position 1 of FIG. 14, the butt 114 of the needle proper of the needle for split knit and of the needle for knit contacts the raising slope of the raising cam 141. At this time, the slider butt 119 is in the retracted position (initial position). FIG. 17 shows the state of needles at this time. At the position 2 of FIG. 14, the butt 114 of the needle proper of the needle for split knit and of the needle for knit rises along the raising slope of the raising cam 141 up to the shoulder position. The slider butt 119 rises along the slope 161 that leads to the guide surface 157 having the half height of the slider cam lock 137, and after that, the slider butt 119 is pushed out by the advancement of said needle proper and enters onto the guide surface 157 having the half height of the slider cam lock 137 (FIG. 18). At the position 3 of FIG. 14, the butt 114 of the needle proper of the needle for split knit and of the needle for knit rises to the top of the raising cam 141 of the leading needle proper cam lock 135 and the hook advances most, and the slider butt 119 is guided through the connecting route 155 into the center guide groove 153 being the deepest. FIG. 19 shows the state of needles at this time, and the old stitch loop 170 being held on the needle of the front needle bed is held on the throat of the needle above the slider tongues 110.

At the position 4 of FIG. 14, the butt 114 of the needle proper of the needle for split knit and of the needle for knit is cleared down to the shoulder position of the raising cam 141 by the clearing cam surface of the bridge cam 145. The slider butt 119, however, remains to be guided in the center guide groove 153. As shown in FIG. 20, when the hook 115 gets a little closer to the tongues 110, yarn 182 is fed by a yarn feeder 180. After that, the select jack butt 128 of the needle for split knit is pressed by the split knit presser 149 being set in the position A and having the half height. As a result, the butt 128 is sunk by about half height. By this, the needle proper butt 114 and the slider butt 119 are also sunk into the needle groove similarly by about the same amount. In contrast to them, other needles for knit being selected in the position H are not subject to the action of pressers, and the respective butts hold their most extruding states. At the position 5 of FIG. 14, the butt 114 of the needle proper of the needle for split knit and of the needle for knit retracts a little along the clearing slope of the stitch cam 143*r*, and the tip of the hook 115 contacts the tips of the tongues 110 to close the hook mouth. At this time, yarn 182 being fed has been captured by the hook.

At the next position 6 and beyond, the butt 114 of the needle proper of the needle for split knit and of the needle for knit follows the same route. However, the route of the slider butt 119 differs. The butt 114 of the needle proper of the needle for knit retracts along the clearing slope of the stitch cam 143*r*. On the other hand, as the entirety of the slider butt 119 is protruding above the top face of the needle bed, the slider butt 119 contacts a clearing slope 165*a* at a side edge of the first bypass groove 165, having the half height, of the slider cam 137, and passes through the leading cam lock 133 (broken line in the diagram). As a result of this, both the needle proper 103 and the slider 105 retract to the initial positions, and a newly formed stitch loop 173 is held by the hook 115 and the old stitch loop 170 is knocked over from the tip of the slider beyond the hook.

On the other hand, the needle proper butt 114 of the needle for split knit is cleared, just like the needle for knit, along the clearing slope of the stitch cam 143*r* to the initial position. As the slider butt 119 is pressed by the split knit presser 149 to about half height, the slider butt 119 does not contact the clearing slope 165*a*. The slider butt 119 moves straight and is guided from the center guide groove 153 into the bypass groove 165. As a result, a new stitch loop 173 is held on the hook 115, and the old stitch loop 170 is held on the slider tongues 110 (7 of FIG. 14, FIG. 19).

When the trailing cam lock 133 works, the select jack butt 128 is retracted by the guide cam 142 to the position B, and the select jack butt 128 is sunk into the needle groove by the B-presser 147 located in that position. As a result, the needle proper butt 114 passes without being subjected to any cam operation.

After this, till the completion of split knit, the needle proper 103 of the needle of the front needle bed holds the initial position. At the position 8 of FIG. 14, the slider butt 119 is guided from the first bypass groove 165 to the second bypass groove 167, and on the rear needle bed, before the needle corresponding to this enters the trailing cam lock, the needle is selected to be in the position H by the selection system (not illustrated) of the carriage. Then the needle advances along the raising slope of the raising cam 141 and inserts the hook into the old stitch loop 170 being held on the slider tongues 110 of the needle of the front needle bed (FIG. 24).

At the position 9 of FIG. 14, the slider butt 119 of the front needle bed being positioned in the second bypass groove 167 of the slider cam lock 137 is lowered and guided into the center guide groove 153. As a result of this, the old stitch loop 170 being held on the tongues 110 is transferred to the hook 115 of the needle of the rear needle bed B (FIG. 25). At this time, the slider butt 119 of the needle of the rear needle bed B is pushed by the advancement of the needle proper butt 114 to move from the slope 161 into the guide surface 157. And the select jack butt 128 is pressed to sink by the H-presser 148. As a result of this, the needle proper butt 114 does not advance to the top of the raising cam 141 and holds the height of the shoulder and is guided to the stitch cam 143*r* (FIG. 26).

At positions 10 and 11 of FIG. 14, the needle of the rear needle bed is cleared by the stitch cam 143*r* of the trailing cam lock 133, and the slider butt 119 being on the guide surface 157 is retracted along the slope of the slider guide cam 132 to the initial position. Similarly, the slider 105 of the front needle bed is lowered along the slope of the slider cam 132 to the initial position. As a result of this, the needle of the front needle bed holds the loop and the needle of the rear needle bed holds the loop, and split knit is completed (FIG. 27, and needles f, f in step B of FIG. 29).

According to the prior art as described above, between the position 5 and the position 6, when the slider butt 119 of the needle for split knit and the slider butt 119 of the needle for knit, which have been guided over the same route, are selected for their respective routes, the needle proper butt 114 of the needle for split knit and the needle proper butt 114 of the needle for knit will retract along the stitch cam 143*r*. At this time, the slider 105 will move as the needle proper 103 retracts. It is the so-called inadvertent movement. This inadvertent movement will make the old stitch loop 170 of split knit being held on the slider drop from the tip of the slider 105. As a result, the old stitch loop 170 will be held on the needle hook again. As a result, the trailing cam lock 133 can not transfer the old stitch loop 170 to the needle of the opposing needle bed. Thus split knit can not be completed.

A method of suppressing this inadvertent movement of the slider is to increase the sliding resistance between the needle groove and the slider. This, however, can not prevent occurrence of the inadvertent movement of the slider completely. If the sliding resistance between the slider and the groove needle is increased excessively, it will pose problems such as the durability of the needle.

SUMMARY OF THE INVENTION

One object of the present invention is to provide a flat knitting machine which prevents a slider from moving inadvertently with retraction of a needle proper when slider butts of compound needles are sorted into a split knit route and a knit route, because of this, holds an old stitch loop for split knit being held on the slider and prevents the old stitch loop from dropping from the tip of the slider and transfers the old stitch loop to a needle of the opposing needle bed by a trailing cam lock to reliably make split knit.

In a flat knitting machine according to the present invention, in needle grooves of needle beds being arranged to oppose each other, one in the front and the other in the rear, with a trick gap between them, are arranged compound needles having a slider, said slider including two blades with a tongue formed in the head thereof, a needle proper with a hook formed in the head thereof, and a select jack, said compound needles opening and closing the hook by relative movement of the slider and the needle proper, and said tongues of the slider being capable of advancing beyond the hook, a needle proper butt is protrusively provided on the top face of each needle proper, and an elastic foot is provided in the rear of the needle proper to make the needle proper butt sinkable in the needle groove, each slider is held on the needle proper, and a first butt being located on the front side and a second butt behind the first butt are protrusively provided on the top face of the slider, and each select jack is arranged in the rear of and above the needle proper, a select jack butt is protrusively provided on the top face of the select jack, and the select jack can change the position between an initial position and an advanced position, a carriage reciprocating over said needle beds is provided with a needle proper cam lock including a bridge cam, a stitch cam and a raising cam which contact said needle proper butt to advance and retract the needle proper, a slider cam lock including a guide cam contacting said second butt to advance and retract the slider, and a presser system being capable of selectively press said select jack butt, said needle proper butt and said second butt being made sinkable into the needle bed by pressing action of a presser, and in relation to the carriage, for split knit, said slider cam lock further comprising a split knit bypass route guiding the second butt of the slider to the trailing cam lock while the slider is being kept in the position into which the slider is advanced by the slider cam lock, and a split knit cam preventing the second butt of said slider from leaving the split knit bypass route, and is provided a guiding means that guides the first butt of the slider to engage with said split knit cam.

Preferably, said guiding means comprises a split knit presser of half height for halfly sinking said select jack butt into the needle groove, and a base of half height which extends at least to one end of said bridge cam, engage with a needle proper butt of a compound needle of which select jack is not sunk and does not engage with a needle proper butt of a compound needle of which select jack is halfly sunk.

Preferably, said guiding means comprises a raising cam of half height which is provided in the slider cam lock, on the leading side of said split knit cam, engages with the second butt and advances the first butt to a position at which the first butt engages with said split knit cam, and a split knit presser of half height which halfly sink said select jack butt into the needle groove.

Further, preferably, said guiding means comprises a first clearing surface of half height which is provided on said stitch cam, a second clearing surface of the full height which is provided on the trailing side of the first clearing surface and guides said second butt to said split knit bypass route, and a split knit presser of half height which halfly sinks said select jack butt into the needle groove.

Preferably, each of said slider cam lock and said needle proper cam lock is provided, in addition to stitch loop forming routes of knit, tuck and miss, with a stitch loop transfer route.

The flat knitting machine of the present invention is provided with a guiding means which engages the first butt of the slider of a needle for split knit and a split knit cam provided in the slider cam lock. As the needle proper is cleared when the first butt of the slider and the split knit cam are in engagement with each other, advertent movement of the slider will not occur. As a result, the second butt of the slider is reliably guided into the split knit bypass groove and split knit is made by the trailing cam lock.

Further, according to the present invention, to select for split knit at the route selecting point, the select jack butt is pressed by the split knit presser of half height to sink the butt of the needle proper and the second butt of the slider halfly into the needle groove. While receiving the pressure from the split knit presser, the needle proper butt passes through the base of half height of the bridge cam to the stitch cam, and the second butt of the slider is guided into the bypass route. During this time, the needle proper and the slider are not subjected to cam operation and move parallel without changing their positions. As a result, the first butt of the slider and the split knit cam which is provided in the slider cam lock will engage with each other. As the needle proper butt is cleared by the stitch cam while this engagement persists, the slider will not make any inadvertent movement and the slider will not drop together with the needle proper.

BRIEF DESCRIPTION OF THE DRAWINGS

FIG. 2-*a* shows the needle which is not being subjected to any pressing action of a presser and the butts of the needle are protruding from the needle groove. FIG. 2-*b* shows a state when butts of the needle are being pressed by the presser.

FIG. 4-*a* shows almost the entirety of the needle, and FIG. 4-*b* shows an enlarged view of a part of FIG. 4-*a*.

FIG. 16-*a* shows the state when the butts of the needle are protruding from the needle groove as they are not subjected to any pressing action of a presser.

FIG. 16-*b* shows the state when butts of the needle are pressed by the presser.

EMBODIMENTS

Embodiment 1

Figure 1:
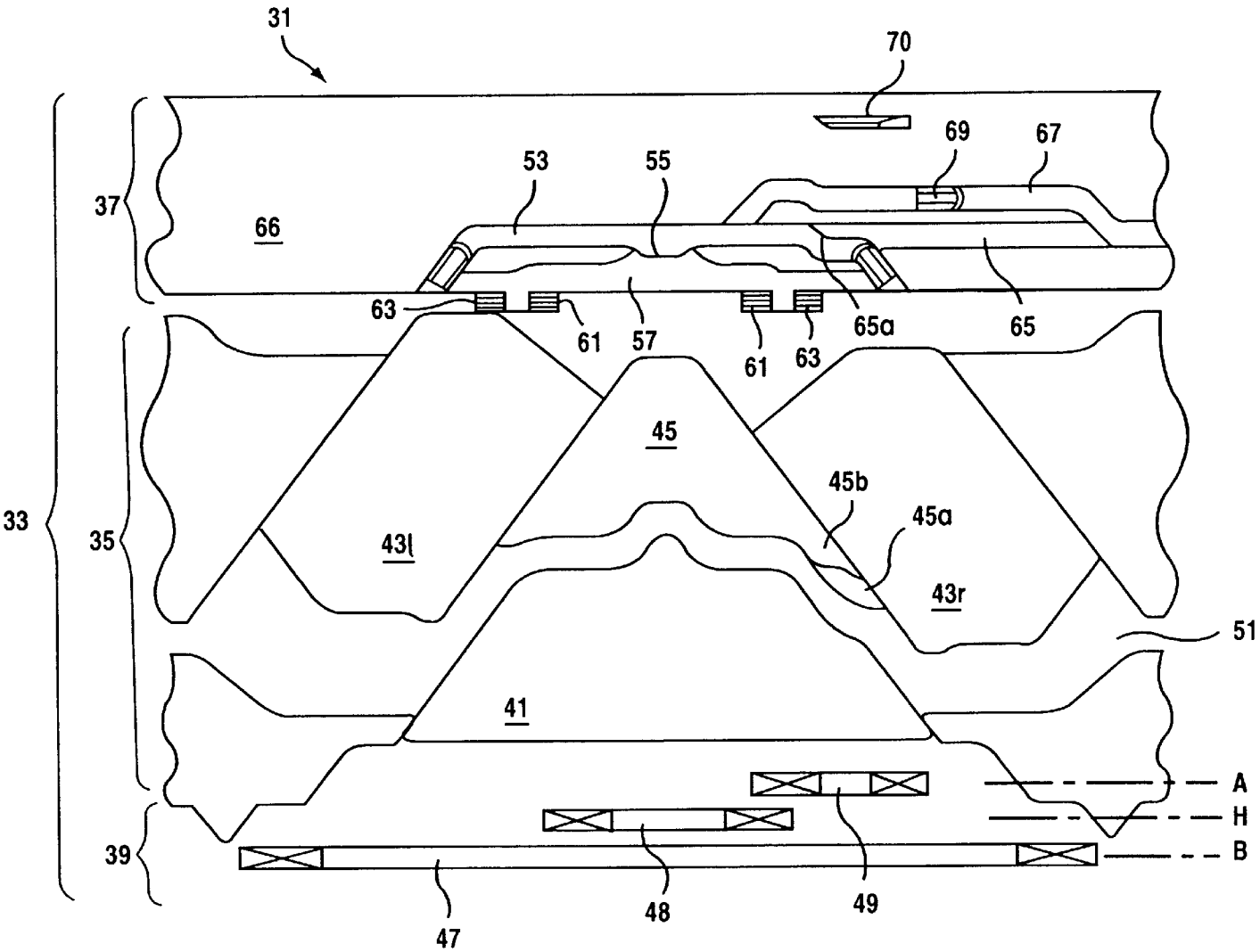
FIG. 1 is a bottom view of the leading cam lock of the flat knitting machine of the first embodiment.

The carriage of the present embodiment is designed to have a double cam system in which two cam locks, a leading cam lock and a trailing cam lock (not illustrated), are provided. These cam locks are symmetrical to each other with respect to a vertical axis, and FIG. 1 shows only the leading cam lock.

Figure 2A:
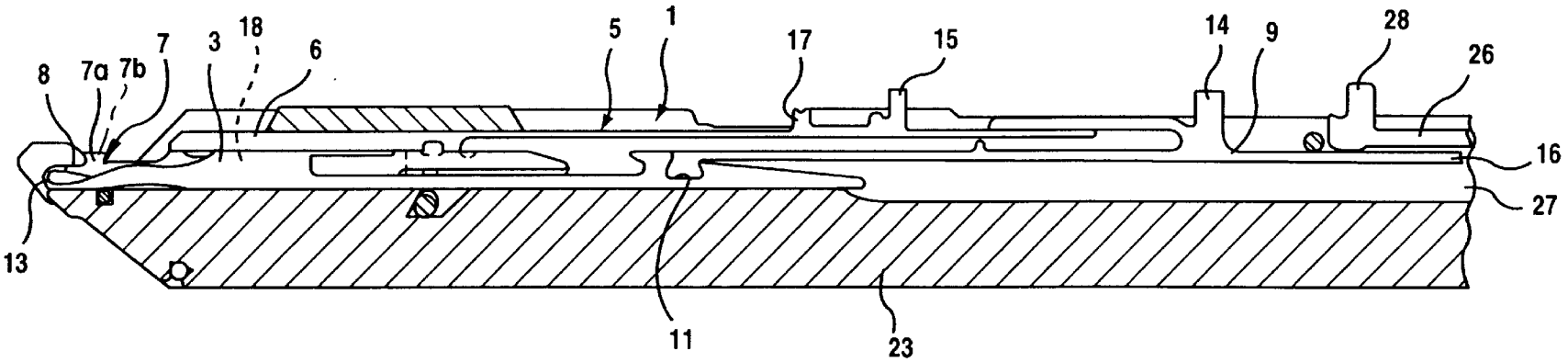
FIG. 2 is a sectional view of a part of a needle.
Figure 2B:
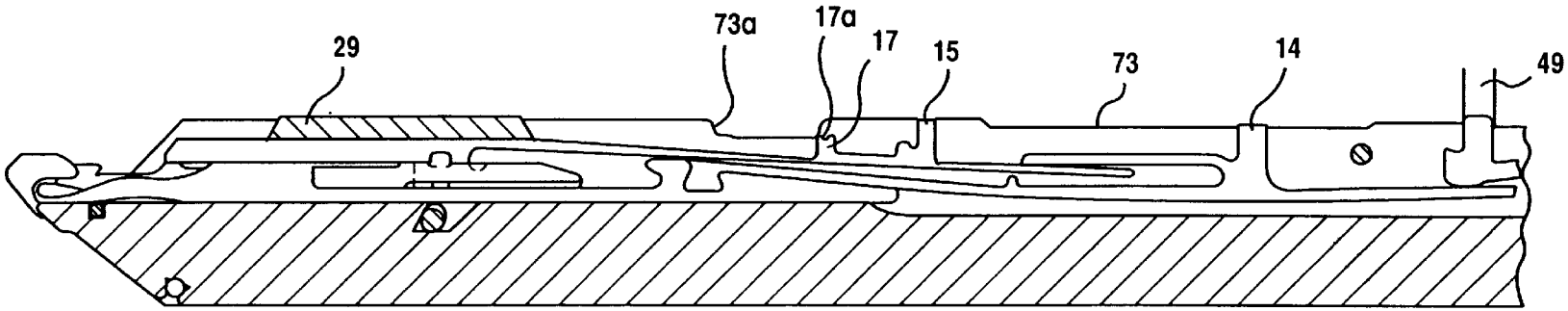

FIG. 2 is a sectional view of the needle bed. The basic configuration of the needle 1 is substantially identical to that of prior art described above. The needle 1 has a needle proper 3, and a slider 5 comprising a slider proper 6 and two blades 7*a*, 7*b* being overlapped with each other. The needle proper 3 has a recess 11 near the tail thereof, and the recess 11 engages with the tip of the needle jack 9. A slider groove 18 is formed from the throat of the root of the hook 13 of the needle proper 3 up to the middle of the needle proper 3. The slider proper 6 has a second butt 15 near the tail thereof and a first butt 17 on the front side thereof. A blade retainer 19 is provided protrusively on the bottom face of the slider proper 6 near the tip thereof. Blades 7*a*, 7*b* are fit in the slider proper 6 by means of the blade retainer 19. Blades 7*a*, 7*b* are almost identical in configuration, and each blade has a tongue 8 at its tip. As shown in the diagram, a recess is formed in a center 17*a* of the top end of said first butt 17. A protrusion of a split knit cam 70 that is provided on the carriage and will be described later is arranged to fit into this recess 17*a*. 16 denotes an elastic foot, 23 denotes a needle bed base, 27 denotes a needle groove, and 29 denotes a metal plate, respectively.

Next, the cam lock 33 of the carriage 31 will be described. The cam lock 33 has a needle proper cam lock 35, a slider cam lock 37, a presser system 39, and selection systems that are provided behind the presser and on both sides thereof and will be described later. The cam lock 33 has a raising cam 41 in the center, stitch cams 43 on both sides of the raising cam 41, and a bridge cam 45 ahead of the raising cam 41. 47 denotes a B-presser, 48 denotes an H-presser, and 49 denotes an A(split knit)-presser. The H-presser 48 and the split knit presser 49 are arranged so that they can be switched between in and out conditions. Only the split knit presser 49 has the half height, other pressers have the full height.

As for the passage route of the second butt 15 of the slider 5, a center guide groove 53 is provided ahead of the stitch cams 43. And a guide surface 57 is provided in parallel with the center guide groove 53 in the rear of the guide groove 53 and closer to the bridge cam. A connecting route 55 is provided between the center guide groove 53 and the guide surface 57. The depth of said center groove guide 53 is the deepest. It is at the same height (zero height) of the face of the carriage base 51 on which the cam lock is mounted. The guide surface 57 is higher than that and is the half height, and the surface height of the slider cam 66 of the slider cam lock 37 is the full height. Near both side ends of the guide surface 57, there are side slopes 61, 63, one on the right and one on the left, and these slopes drop to the same height of the face of the carriage base 51. A first bypass groove 65 and a second bypass groove 67 are connected to the center guide groove 53 and the center guide groove of the trailing cam lock that is not illustrated. A slope 69 in the second bypass groove 67 changes its height from the half height to the zero height. The height between the center guide groove 53 and the slope 69 is set at the half height.

To guide the slider 5 of a needle for split knit to a specified route, a split knit cam 70 is protrusively provided on the cam surface of the slider cam 66 at a route selection point. The guide cam 70 engages with the first butt of the slider 5 to prevent the second butt from coming off the split knit bypass route. The split knit bypass groove 65 is provided in the slider cam lock 37 to guide the slider 5 to the trailing cam lock while keeping the second butt in the advanced position. Further, to guide the first butt of the slider 5 into engagement with said split knit cam 70, a guiding mechanism is provided. This guiding mechanism comprises the split knit presser 49 that is provided in said presser system, and the base of the full height and the base of half height (clearing cams) 45*a*, 45*b* provided in the bridge cam 45. These clearing cams 45*a*, 45*b* extend downward in the needle proper cam lock 33, having the full height and the half height, respectively.

The needle plates 73, which are inserted into the needle bed base 23 to form needle grooves 27, differ from those of the prior art. The top edge 73*a* of the needle plate 73 is formed to be one step lower than the rest to allow engagement of the first butt 17 of said slider 5 and said split knit cam 70.

The split knit cam 70 engages with the first butt 17 of the slider 5 to prevent inadvertent movement of the slider 5. The operations of the first butt 17 and of the split knit cam 70 will be described later.

Next, split knit by means of the flat knitting machine and cam operations of the cam lock of the carriage and the moves of the needles of the front and rear needle beds a the time of split knit will be described.

Figure 3:
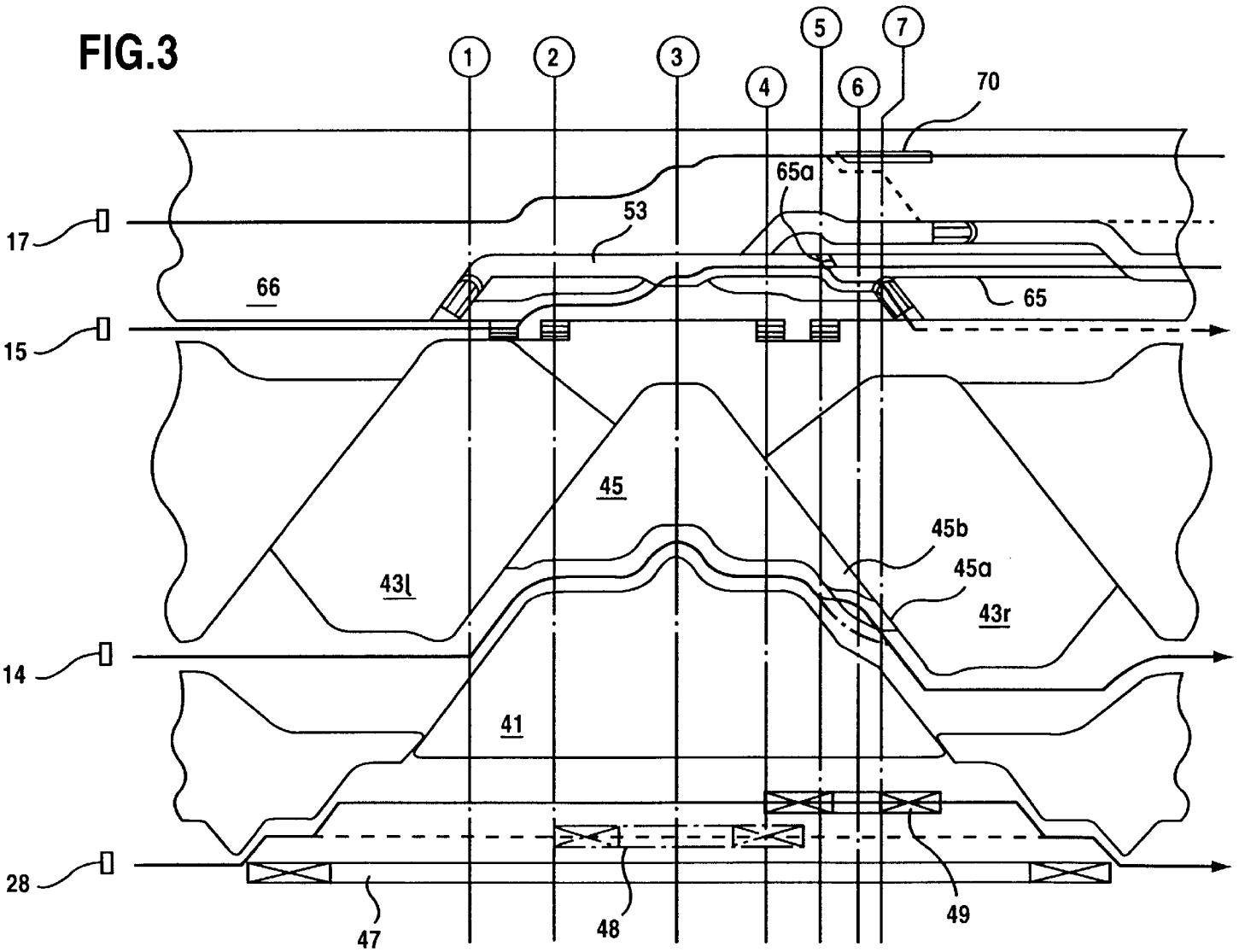
FIG. 3 is a bottom view of cams showing the passage routes of the respective butts and cam actions in the positions 1 through 7 of the leading cam lock at the time of split knit.
Figure 17:
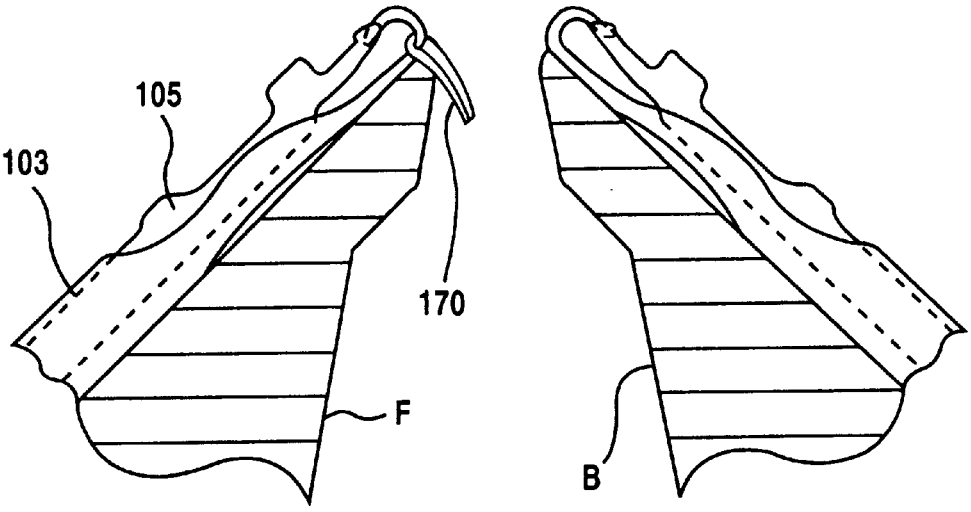
FIG. 17 is a sectional view showing the positions of the front and rear needles in the position 1 of FIG. 10 at the time of split knit.
Figure 18:
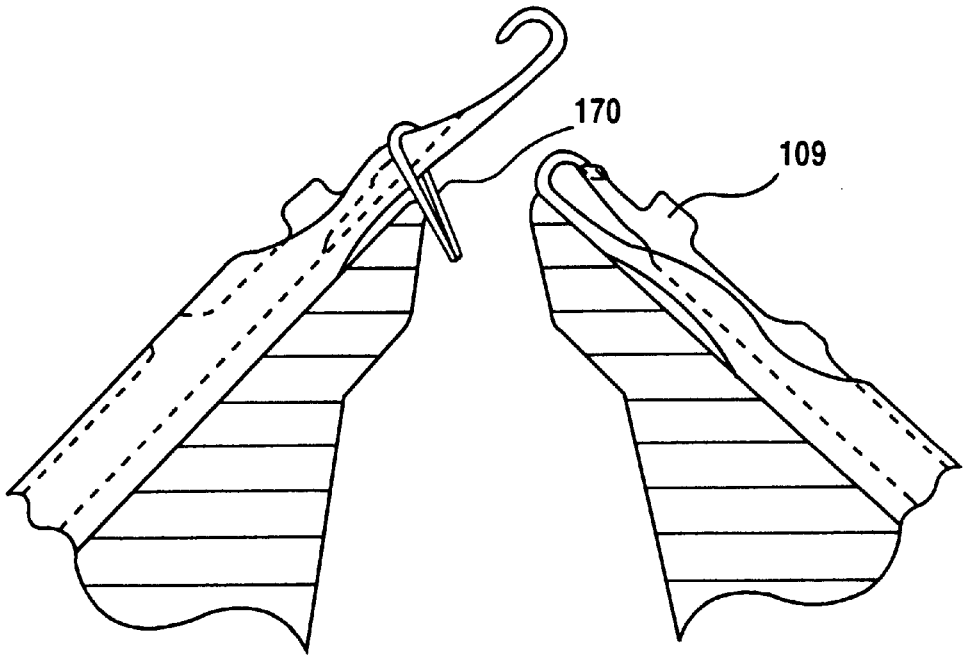
FIG. 18 is a sectional view showing the positions of the front and rear needles in the position 2 of FIG. 10 at the time of split knit.
Figure 24:
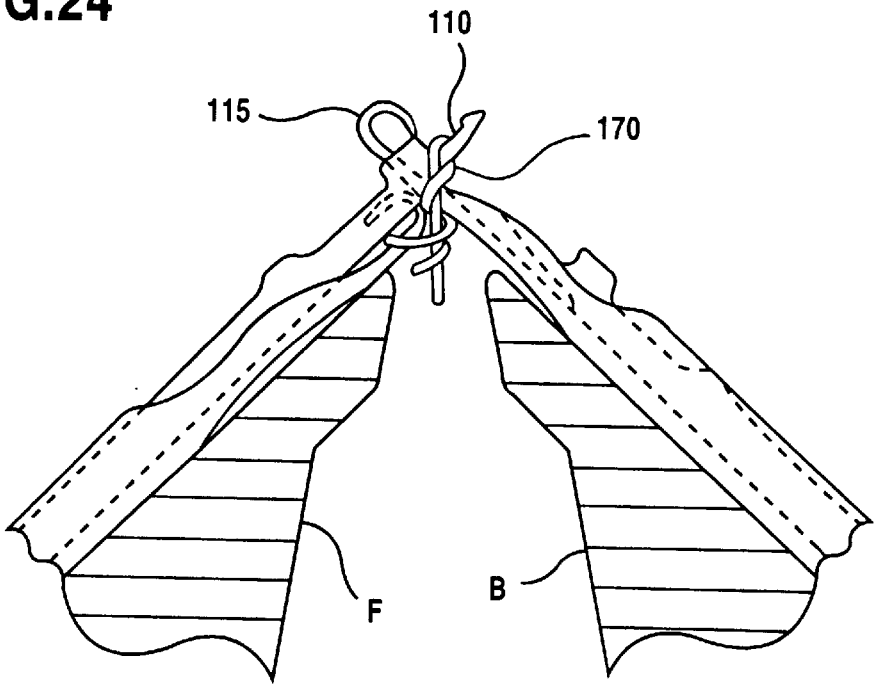
FIG. 24 is a sectional view showing the positions of the front and rear needles in the position 8 of FIG. 10 at the time of split knit.
Figure 25:
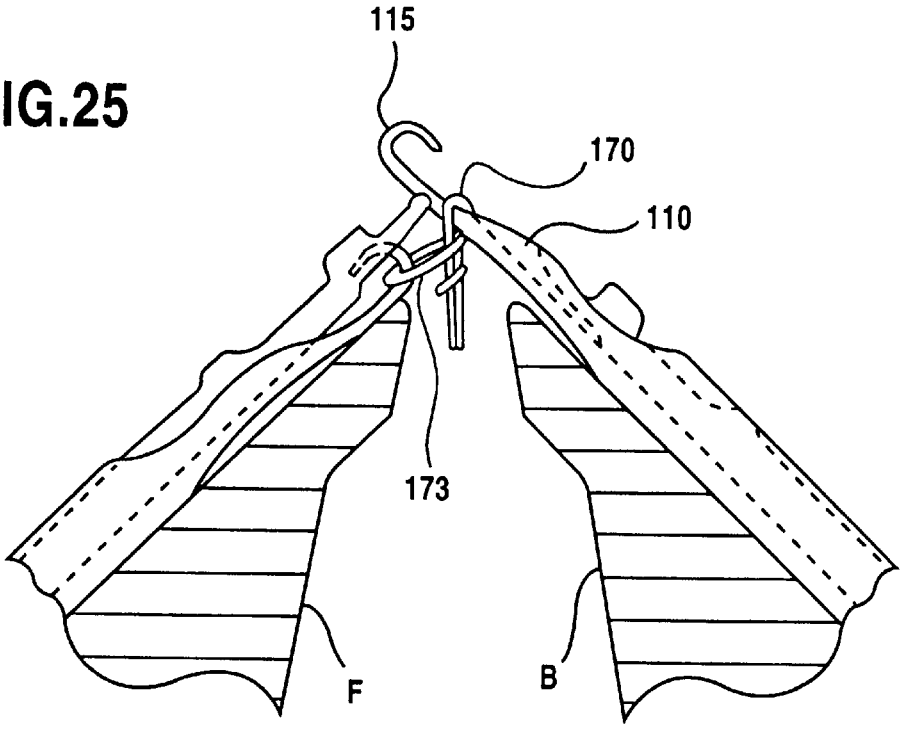
FIG. 25 is a sectional view showing the positions of the front and rear needles in the position 9 of FIG. 10 at the time of split knit.
Figure 26:
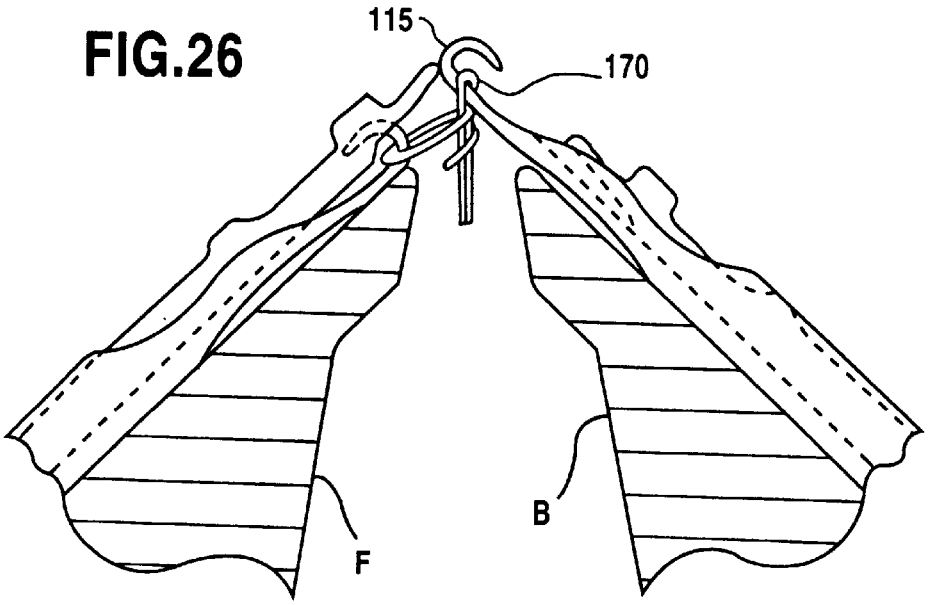
FIG. 26 is a sectional view showing the positions of the front and rear needles in the position 10 of FIG. 10 at the time of split knit.
Figure 27:
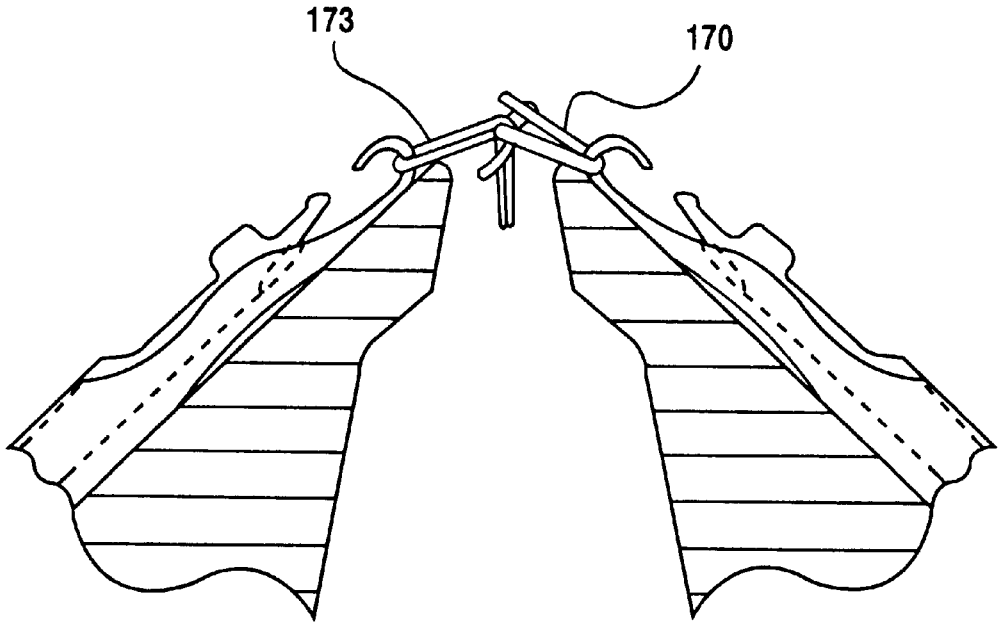
FIG. 27 is a sectional view showing the positions of the front and rear needles in the position 11 of FIG. 10 at the time of split knit.

The fabric to be knitted and the knitting steps are identical to those described with reference to FIG. 24 and FIG. 25, and their descriptions are omitted here. In FIG. 3, the movements of the needle for split knit at positions 1 through 4 are identical to those of FIG. 13 through FIG. 16. At the position 5, the needle proper butt 14 of each needle is retracted a little by the base 45*b* of the full height of the bridge cam 45 to contact the tip of the hook 13 to the tips of the tongues 8 of the slider 5 and close the hook mouth. Yarn fed at this time is captured by the hook 13 as shown in FIG. 17.

Figure 4A:
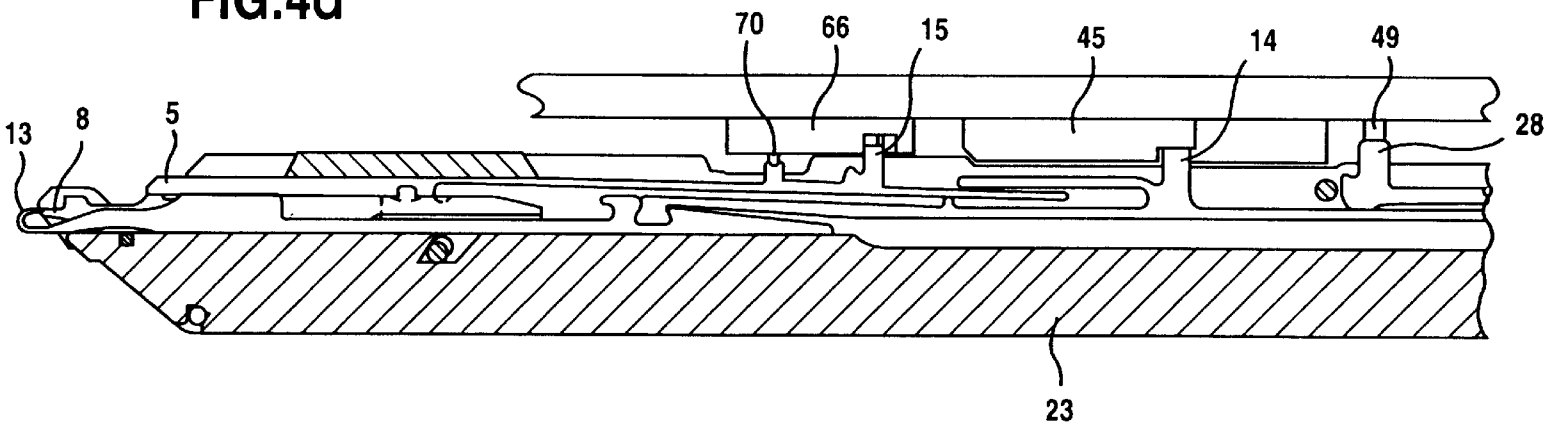
FIG. 4 is a sectional view of the needle bed showing the state of engagement of the first butt of the slider and the split knit cam at the time of split knit.
Figure 4B:
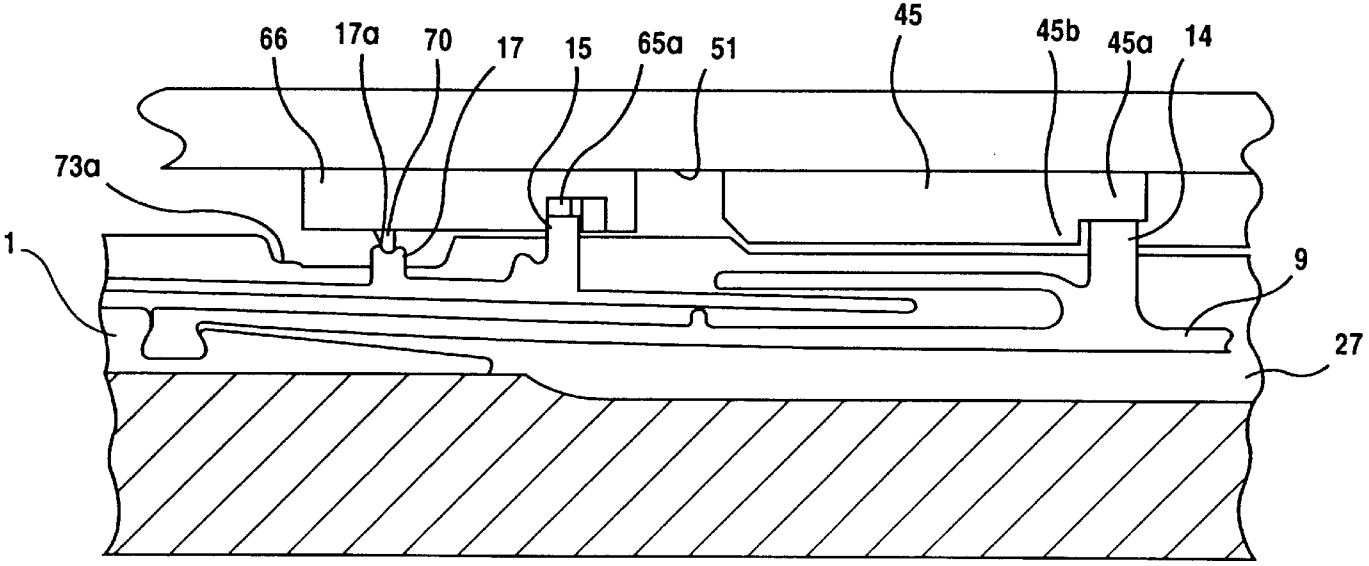
Figure 5:
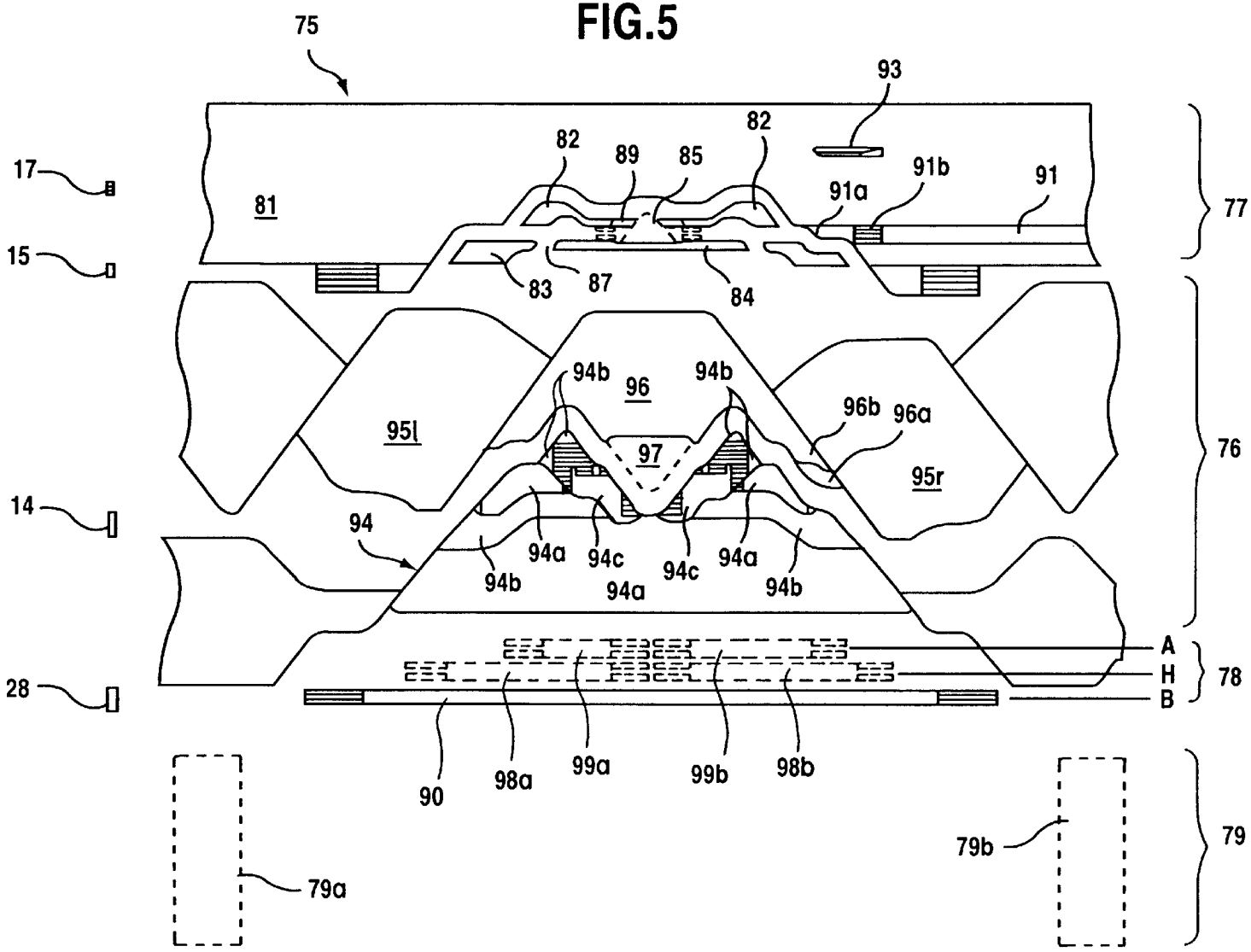
FIG. 5 is a bottom view of the cam lock of the flat knitting machine of the second embodiment.
Figure 6:
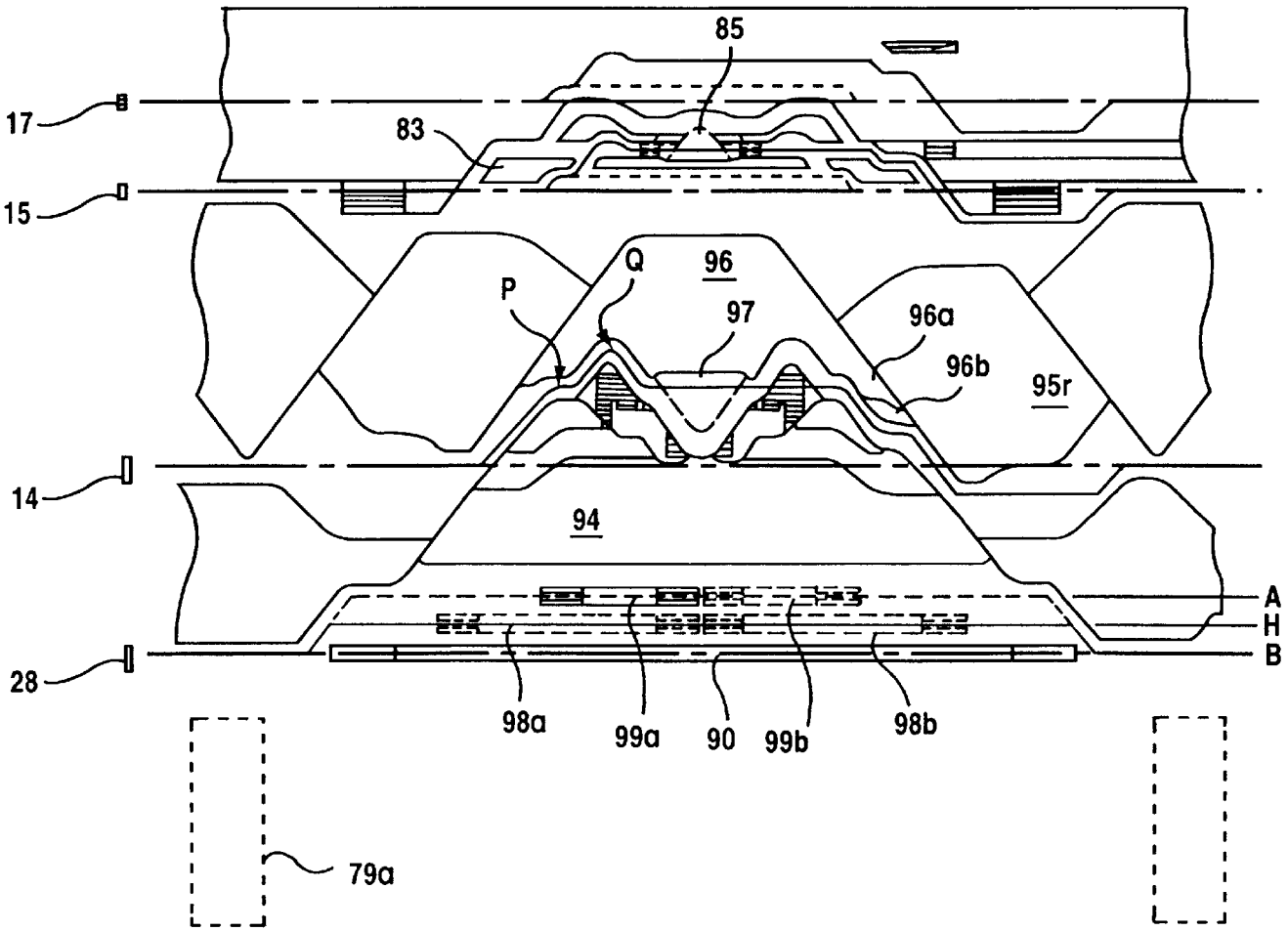
FIG. 6 is a diagram showing the passage routes of the respective butts and cam actions in the cam lock of FIG. 5 at the time of knitting of knit, tuck and miss.

After the hook mouth of the hook 13 of each needle is closed at the position 5, prior to the succeeding position 6, needles for split knit and those for knit are sorted into specified routes. A needle for split knit being in the position A is pressed by the split knit presser 49 and the respective butts take the state of the half height shown in FIG. 4-*a*. FIGS. 4–6 shows a magnified view of a part of FIG. 4-*a*. Because of this, the butt 28 of the select jack corresponding to the needle for split knit is pressed by the split knit presser 49, and the needle proper butt 14 and the slider second butt 15 move straight on without engaging the bridge cam base 45*a* having the half height and the clearing cam surface 65*a* having the half height of the first bypass groove.

As shown in FIG. 4, at the position 5, the second butt 15 of the slider 5 is in a state of being guided in the center guide groove 53, and at the time, the first butt 17 is at 73*a* of the needle plate 73. The surface height of 73*a* is a step lower than the rest of the needle plate 73, and the first butt 17 is peeping out from the surface of the needle bed. Because of this, while the slider 5 shifts horizontally keeping the same position, the recess 17*a* of the slider first butt 17 fits with the split knit cam 70 being protrusively provided on the cam surface of the slider guide 66. In FIG. 3, the split knit routes of the respective butts are indicated by full line and the routes for knit being different from the former are indicated by broken line.

Other needles for knit being in the position H are not subject to the action of a presser and their respective butts keep the most extruding states. Accordingly, the needle proper butt 14 engages with the clearing cam surface of the base 45*a* having the half height of the bridge cam 45 and retracts as shown by broken line. As for the slider 5, the second butt 15 engages with the clearing cam surface 65*a* of the first bypass groove 65 and follows the route illustrated in the diagram.

At the position 6 and beyond, the needle proper butt 14 of the needle for split knit engages with the stitch cam 43*r* and retracts. On the other hand, as for the slider 5, the first butt 17 is already in engagement with the split knit cam 70, the slider 5 does not make any inadvertent movement to retract when the needle proper retracts.

As explained above, along the route for both the needle for split knit and the needle for knit, the needle proper 3 is retracted by the base 45*b* having the full height of the bridge cam 45 to a position at which the hook mouth of the hook 13 is closed. Next, at the route selection point, the needle proper butt 14 of the needle for knit is retracted by the clearing cam surface of the base 45*a* having the half height of the bridge cam 45, and the second butt 15 of the slider 5 is retracted by the slope 65*a* of the first bypass groove 65. As for the needle for split knit, the butts 14, 15 of the needle proper and of the slider 5 are sunk into the needle groove by the split knit presser 49 having the half height by an amount corresponding to the presser 49. As a result, the needle proper butt 14 passes through, without any interference of the bridge cam base 45*a*, towards the stitch cam 43*r*. The second butt 15 of the slider 5 passes through the first bypass groove 65 and moves towards the second bypass groove 67. While the needle proper 3 and the slider 5 of the needle for split knit shift parallel without being subjected to cam operation, thus keeping their positions, the first butt 17 of the slider 5 is made to engage with the split knit cam 70, and after that, the needle proper butt 14 is cleared by the stitch cam 43*r*. In this way, the slider 5 of the needle for split knit can be reliably prevented from moving inadvertently and the slider 5 can be reliably guided to the route of split knit.

At the position 7 and beyond, both the needle proper 3 and the slider of the needle for knit retract to the initial positions. As a result, a newly formed stitch loop is held on the hook 13, and the old stitch loop is knocked over from the tips of the tongues 8 of the slider 5 beyond the hook 13. The needle proper butt 14 of the needle for split knit is cleared, like the needle for knit, by the clearing slope of the stitch cam 43*r* to the initial position. At the time, the slider butts 15, 17 move straight on, and the second butt 15 is guided from the center guide groove 53 to the first bypass route 65. As a result, a new stitch loop is held on the hook 13 and the old stitch loop is held on the tongues 8 of the slider 5. Like the prior art case, the old stitch loop being held on the slider is transferred to a needle of the rear needle bed by the trailing cam lock (not illustrated) to complete split knit.

Embodiment 2

The carriage of the embodiment 2 uses a single cam system having a single compound cam lock 75 to make knit, tuck and miss, transfer a stitch loop between the front and rear needle beds, and add a route for split knit. The needle used in this embodiment is the same needle used in the first embodiment. In the following, the compound cam lock will be described with reference to drawings.

As shown in FIG. 5, a cam lock 75 is composed of a needle proper cam lock 76, a slider cam lock 77 being ahead of the needle proper cam lock 76 and closer to the trick gap, a presser 78 located behind the needle proper cam lock 76, and a selector 79 located behind the presser 78 and on both sides.

The needle is selected, via the select jack 26, by a selector 79*a* which is leading in the direction of travel, and after that, the needle is carried to the operation cam lock to make knit, tuck, miss or transfer.

The slider cam lock 77 is composed of fixed slider cams 81, 82, 83 and 84 and a first transfer control cam 85 which is arranged in the center of the fixed slider cams and can be selected to be in or out.

A connecting route 87 is formed between the slider cams 83, 84 to give the second butt 15 of the slider 5 access to the route between the slider cams 82, 84. The base of the triangular first transfer control cam 85 is adjacent to the front edge of the slider cam 84. The vertex of the cam 85 faces the route of the second butt 15 which is formed between the slider cams 81, 82. A connecting route 89 of the half height is provided between the slider cam 82 and the first transfer control cam 85 to guide the second butt 15 of the slider 5 to the slider butt groove that is provided in the forefront. The respective slider cams mentioned above are all cams of the full height except the cam 89 of the half height. 91 in the diagram denotes a bypass groove for split knit, 91*a* denotes a portion of the half height, and 91*b* denotes a slope from the half height to the zero height. 93 denotes a split knit guide which engage with the first butt 15 of the slider 5. The bypass groove 91 and the split knit cam 93 are provided only on the front side of the stitch cam 95*r* on the right side.

The needle proper cam lock 76 comprises a two-humped raising cam 94, a pair of stitch cams 95*r*, 95*l* located on both sides of the cam 94, a bridge cam 96 in the front, and a second transfer control cam 97 located between the two humps of the raising cam 94. The bridge cam 96 is provided with a base 96*a* of the half height and a base 96*b* of the full height for split knit. These bases 96*a*, 96*b* are provided, like the above cams 93, 91 for split knit, on the front side of the stitch cam 95*r* on the right. Of the above cams, the raising cam 94 and the bridge cam 96 are fixed cams, and the second transfer control cam 97 is a movable cam that can be switched to be in or out. In the presser 78 in the rear of the raising cam 94, presser cams are provided in positions A, H and B. A B-presser 90 of the full height is provided in the position B. H-pressers 98*a*, 98*b* of the half height covering the right and left humps of the raising cam 94 are provided in the position B. A-pressers 99*a*, 99*b* of the full height covering the vertexes of the humps of the raising cam 94 are provided in the position A. These pressers, except the B-presser 90, are movable presser cams which can be switched to be in or out. The height of the cam surface of the raising cam 94 is formed to vary from part to part. 94*a* is formed to have the full height. 94*b* has the half height, and 94*c* has a height intermediate between the half height and the zero height. The cam 94 works in association with the respective pressers of the above presser 78 to guide the needle proper butt 14 and the slider butt 15 to various routes for knit, tuck, miss, transfer and split knit.

FIG. 6 shows the operating conditions of the cam lock and the passage routes of the respective butts in knitting (knit, tuck and miss). This diagram shows the state when the carriage travels to the left. The route for knit is indicated by full line. The route for tuck and the route for miss, being portions differing from the route for knit, are indicated by broken line and chain line, respectively.

Select jacks 28 of needles for knit, tuck and miss are selected for the respective positions H, A and B by the leading selector 79*a*. Actions of the pressers and cams at the time are illustrated. The fixed B-presser 90 and the leading A-presser 99*a* operate, and the H-presser 98, the trailing A-presser 99*b* and the transfer control cams 85, 97 do not operate.

For knit, the needle proper butt 14 first advances along the left raising cam surface of the raising cam 94. This advances the needle proper 3. As the needle proper 3 and the slider 5 move relative to each other, the hook is opened. When the needle proper butt 14 advances to the shoulder P, the slider 5 is advanced towards the trick gap. At the shoulder P, the slider butt 15 contacts the rear edge of the slider cam 83. The needle proper butt 14 advances further to the top Q of the raising cam 94, and the slider butt 15 is guided through the connecting route 87 into the cam groove between the slider cams 82, 84. After passing the top of the raising cam 94, the needle proper butt 14 is guided by the clearing slope of the bridge cam 96 to retract to the height of the shoulder. Then the needle proper butt 14 keeping that level passes by the hump without interference and advances to the bases 96*a*, 96*b* of the bridge cam and the subsequent stitch cam 95. When the needle proper butt 14 retracts along the stitch cam 95*r*, yarn being fed by a yarn feeder is caught by the hook. The needle proper closes the hook 13, through its movement relative to the slider 5, and retracts to form a knit loop.

For tuck, the needle proper butt 14 advances along the raising cam 94 to the shoulder. After that, the butt 14 is sunk into the needle groove by the leading A-presser 99*a*. Hence the butt 14 is not guided to the top of the raising cam 94 and takes the illustrated route.

Miss is not selected by the selector 79*a*, and the select jack maintains the position B. Hence the select jack butt 28 is sunk by the B-presser 90. As a result, both the needle proper butt 14 and the slider butt 15 are not subjected to advancement/retraction operations of the cams, and they pass the cam lock.

Figure 7:
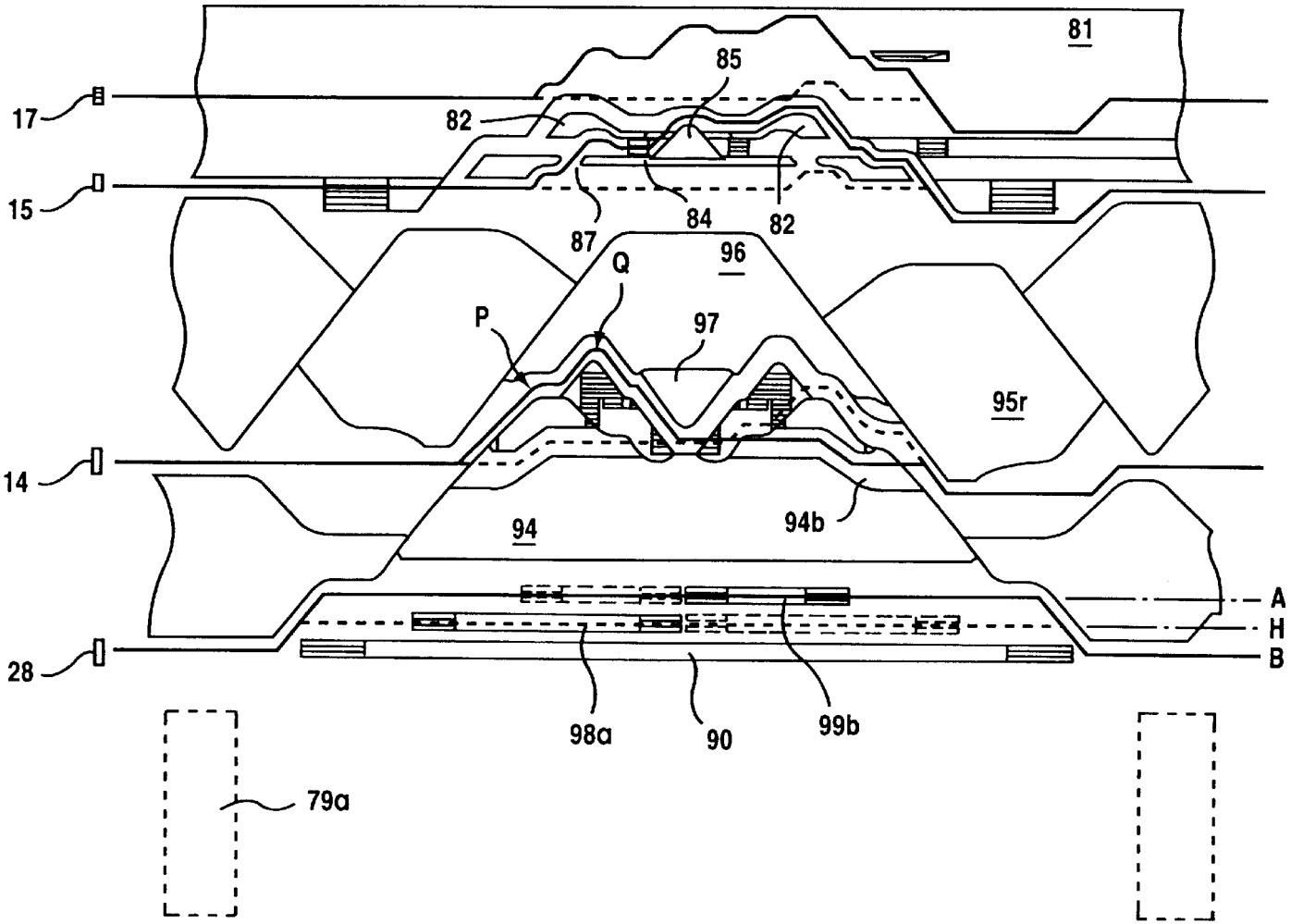
FIG. 7 is a diagram showing the passage routes of the respective butts and cam actions in the cam lock at the time of transfer knit.

Next, with reference to FIG. 7, transfer will be described. FIG. 7 shows the state of transfer (transferring and receiving) when the carriage travels to the left. The route of transferring is indicated by full line, and the route of receiving, being portions differing from the route of transferring, is indicated by dashed line. Transferring is made by a needle of the position A and receiving is made by a needle of the position H. The operations of the pressers and cams at the time are as illustrated. The trailing A-presser 99*b*, the leading H-presser 98*a* and the transfer control cams 85, 97 operate.

In the transferring step, the needle proper butt 14 advances along the raising cam 94 to the shoulder P. At the time, due to the relative movement between the needle proper 3 and the slider, tongues 8 of the slider 5 are sunk in the slider groove 18 and the hook 13 of the needle is opened completely. Next, the needle proper butt 14 is guided to the top Q of the raising cam 94, and this guides the second butt 15 of the slider 5 through the connecting route 87 to the space between the slider cams 82, 84. After that, the needle proper butt 14 retracts along the clearing surfaces of the bridge cam 96 and the second transfer control cam 97. During that time, the second butt 15 of the slider 5 engages with the first transfer control cam 85 and advances to the height of transfer between the slider cams 81, 82. The select jack butt 28 is sunk into the needle groove by the trailing A-presser 99*b*, and the needle proper butt 14 passes without engaging with the hump of the trailing raising cam 94. On the other hand, as for the second butt 15 of the slider 5, although the select jack butt 28 is pressed to the half height by the presser, as a part of the butt 15 protrudes from the surface of the needle bed, the butt 15 is guided between the slider cams 81, 82. The stitch loop is lifted by the slider 5 up to a position where it faces the hook of the receiving needle of the opposing needle bed, and the hook of the receiving needle penetrates the stitch loop. After that, the needle proper butt 14 and the slider second butt 15 retract along the stitch cam 95 and the slider cam 81 to the initial positions.

In the receiving step, the needle proper butt 14 is guided by the action of the leading H-presser 98*a* to the cam part 94*b* of the half height of the raising cam 94. After that, as illustrated, the butt 14 advances along the receiving cam slope to the shoulder of the raising cam 94. As a result, the hook 13 of the receiving needle is penetrated into the stitch loop being held on an opposing needle in the transferring position. When the needle proper butt 14 is retracted by the base of the trailing bridge cam 96 and the stitch cam 95, the needle proper 3 and the slider 5 are retracted to the initial positions.

Figure 28:
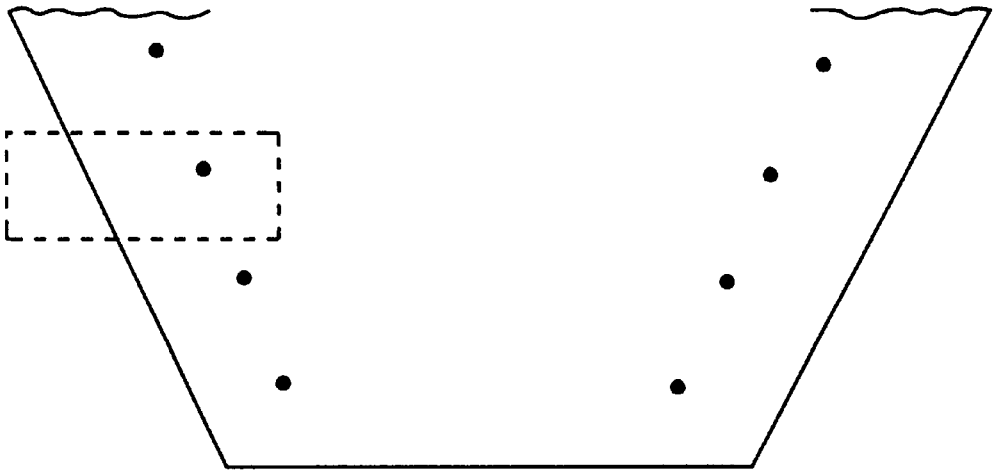
FIG. 28 is a diagram showing a fabric of which knitting width is gradually and internally widened by split knitting on a flat knitting machine.
Figure 29A:
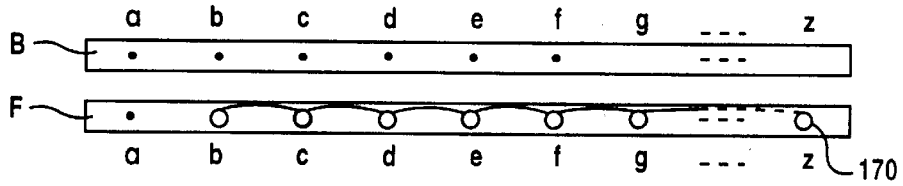
FIG. 29 is a knitting step diagram showing knitting of one course at the left end of the fabric.
Figure 29B:
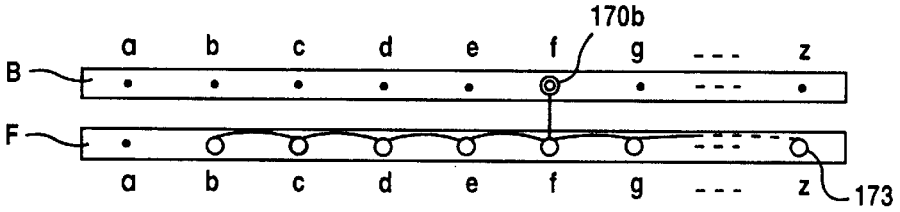
Figure 29C:
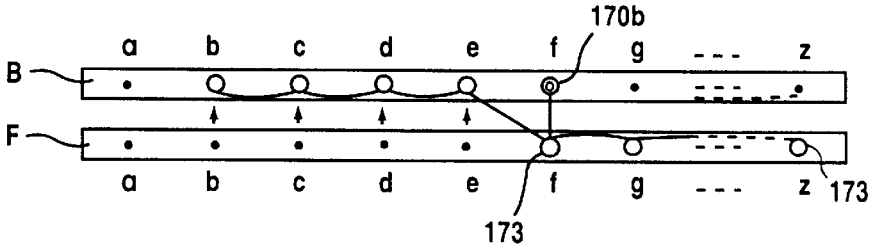
Figure 29D:
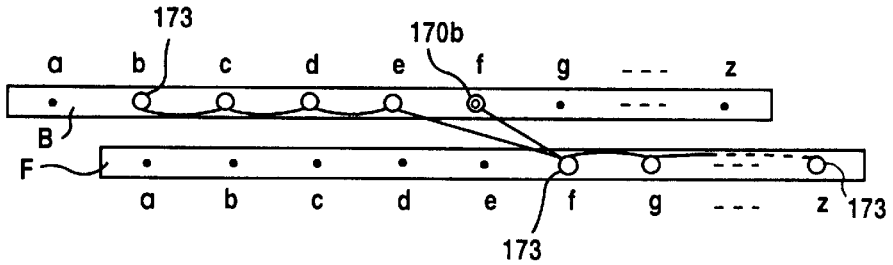
Figure 29E:
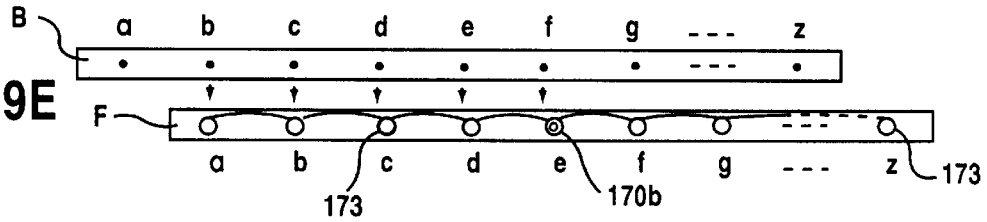
Figure 29F:
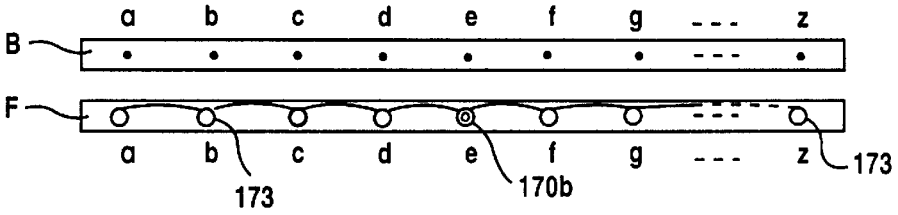

Next, cam operation of split knit with the carriage having the above cam lock and movements of the needles for split knit of the front and rear needle beds will be described. A fabric to be knitted is identical to that mentioned above and shown in FIG. 28. The knitting steps for split knit course is identical to those shown in FIG. 29. In the present embodiment, as split knit is made by a single carriage having a single cam lock, split knit is completed by one round trip of the carriage. In other words, the cam lock to be used for split knit makes the first operation when the carriage travels to the left, and after the reversal of the carriage, the cam lock makes the second operation when the carriage travels to the right. The movements of the needles in the respective positions 1 through 11 are the same to the case of the above embodiment. First, in the travel to the left, the respective butts take the routes shown in FIG. 8 and pass the cam lock 75. Full line indicates the routes of the respective butts in split knit, and the route for knit, being portions differing from the routes for split knit, is shown by dashed line.

In the travel to the left, only the trailing H-presser 98*b* works, and other pressers and transfer control cams do not work. The select jack 26 of the needle for knit is set in the position A, and the select jack 26 of the needle for split knit is set in the position H. The needle for knit takes the same route as that shown in FIG. 6 and yarn is fed by a yarn feeder 180. The butts of the needle proper and the slider 5 of the needle for split knit take the same routes as those for knit up to the position 5. At the position 5, the select jack butt 28 is pressed to the half height by the trailing H presser and the needle proper butt 14 does not engage with the bridge cam base 96*b* of the half height. Similarly, the second butt 15 of the slider 5 does not engage with the clearing surface 91*a* of the bypass groove 91 and moves as illustrated, and the recess 17*a* of the first butt 17 and the split knit cam 93 engage with each other. After that, the second butt 15, being guided by this split knit cam 93, is guided onto the bypass groove 91.

Figure 19:
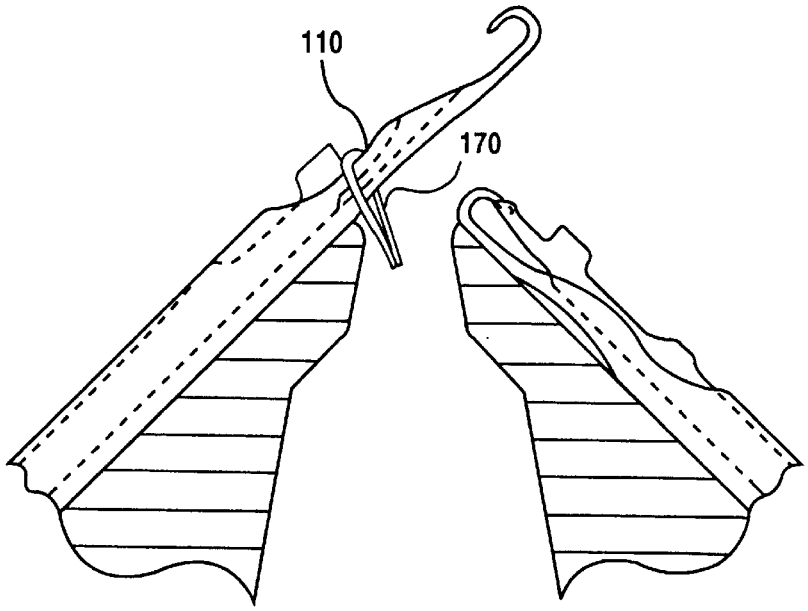
FIG. 19 is a sectional view showing the positions of the front and rear needles in the position 3 of FIG. 10 at the time of split knit.
Figure 20:
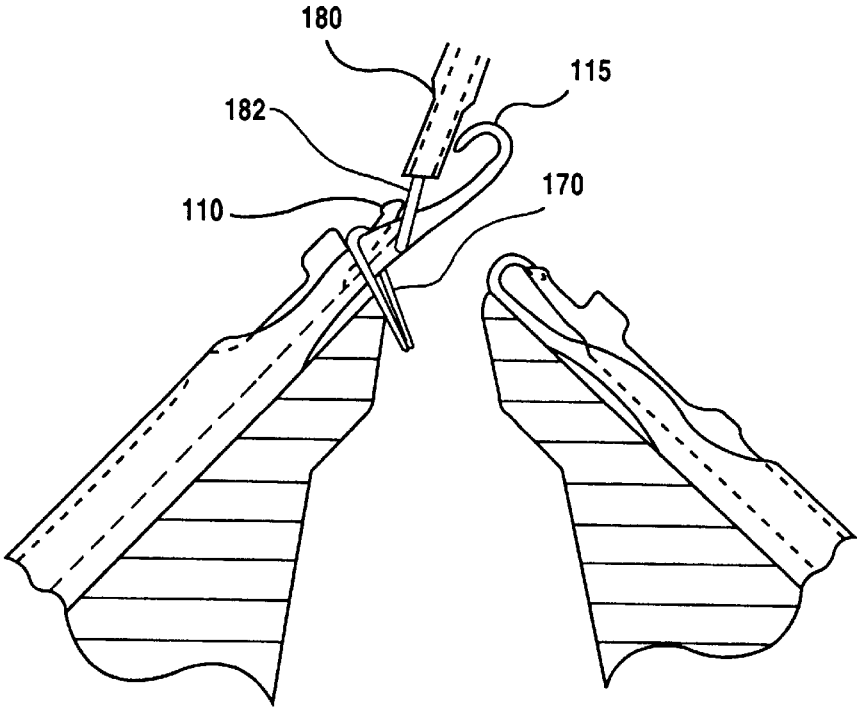
FIG. 20 is a sectional view showing the positions of the front and rear needles in the position 4 of FIG. 10 at the time of split knit.
Figure 21:
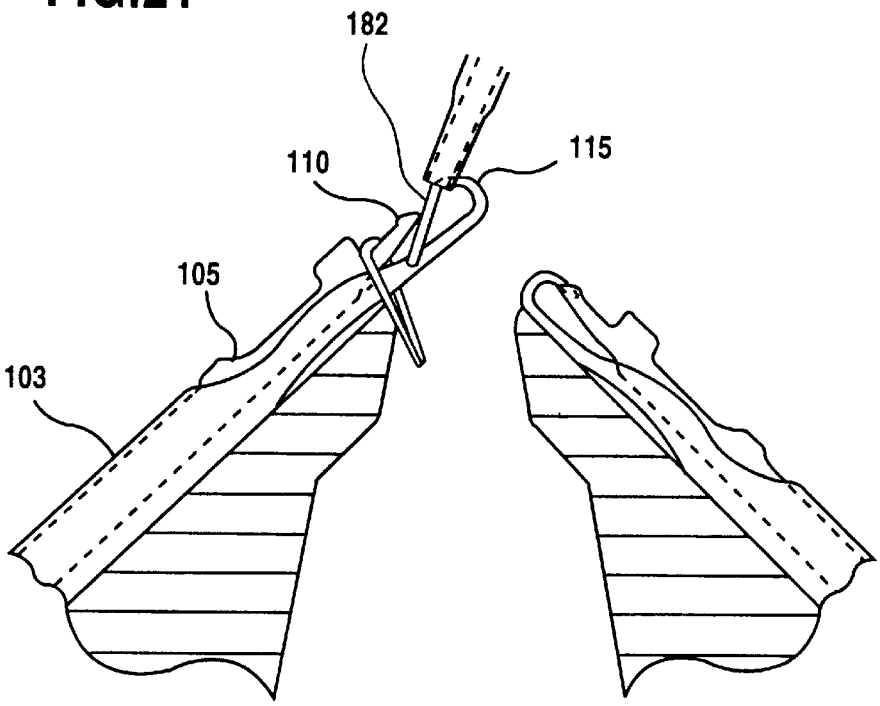
FIG. 21 is a sectional view showing the positions of the front and rear needles in the position 5 of FIG. 10 at the time of split knit.
Figure 22:
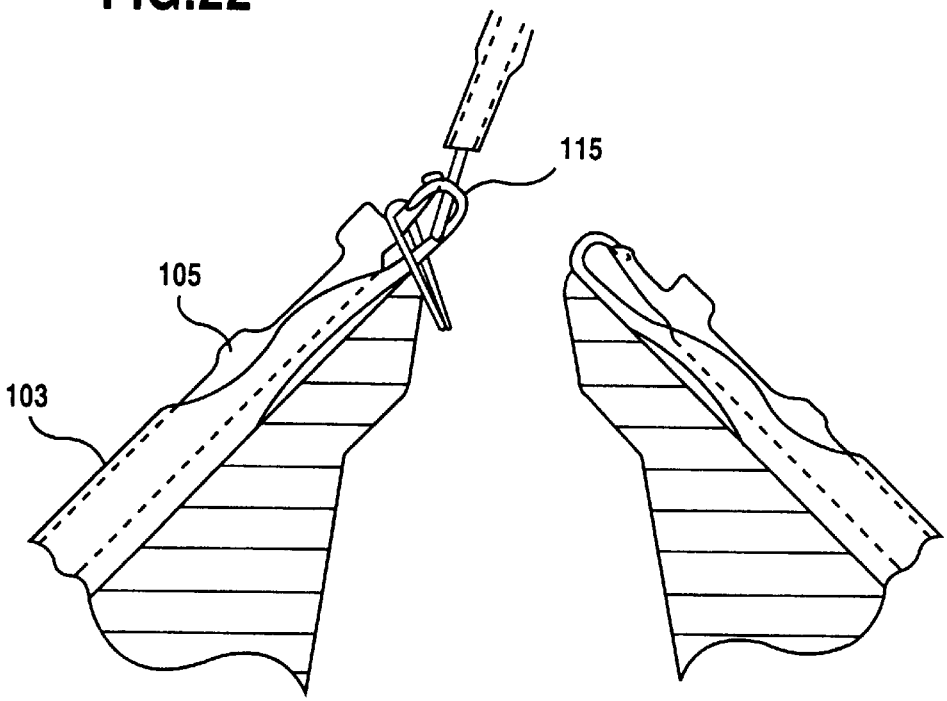
FIG. 22 is a sectional view showing the positions of the front and rear needles in the position 6 of FIG. 10 at the time of split knit.
Figure 23:
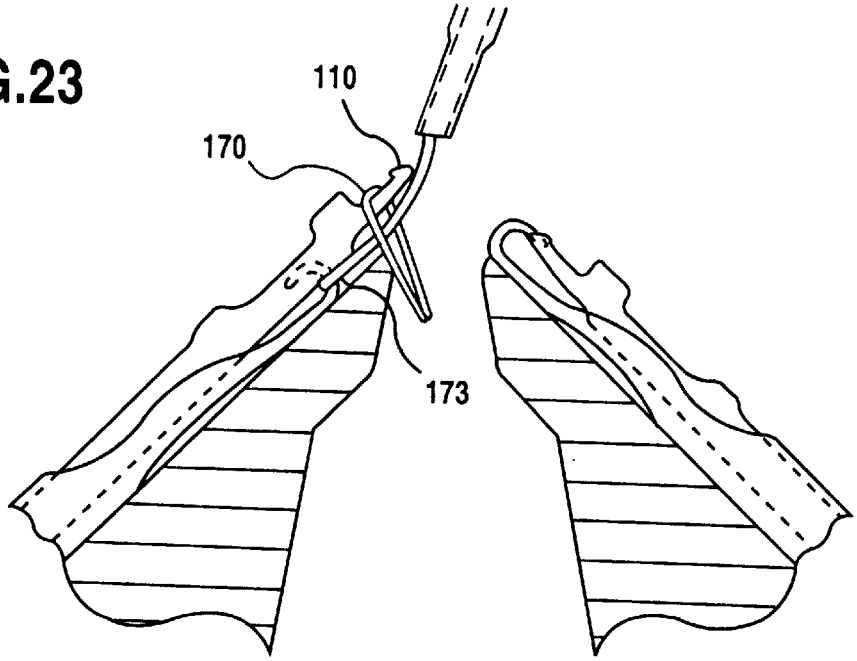
FIG. 23 is a sectional view showing the positions of the front and rear needles in the position 7 of FIG. 10 at the time of split knit.

As for the state after the passage of the carriage, the needle proper 3 is a little more advanced by the guide cam than the state of FIG. 19. Other conditions are almost identical to the state of FIG. 19, and the new stitch loop is held on the hook 13 of the needle, and the old stitch loop is held on tongues 8 of the slider 5.

Figure 9:
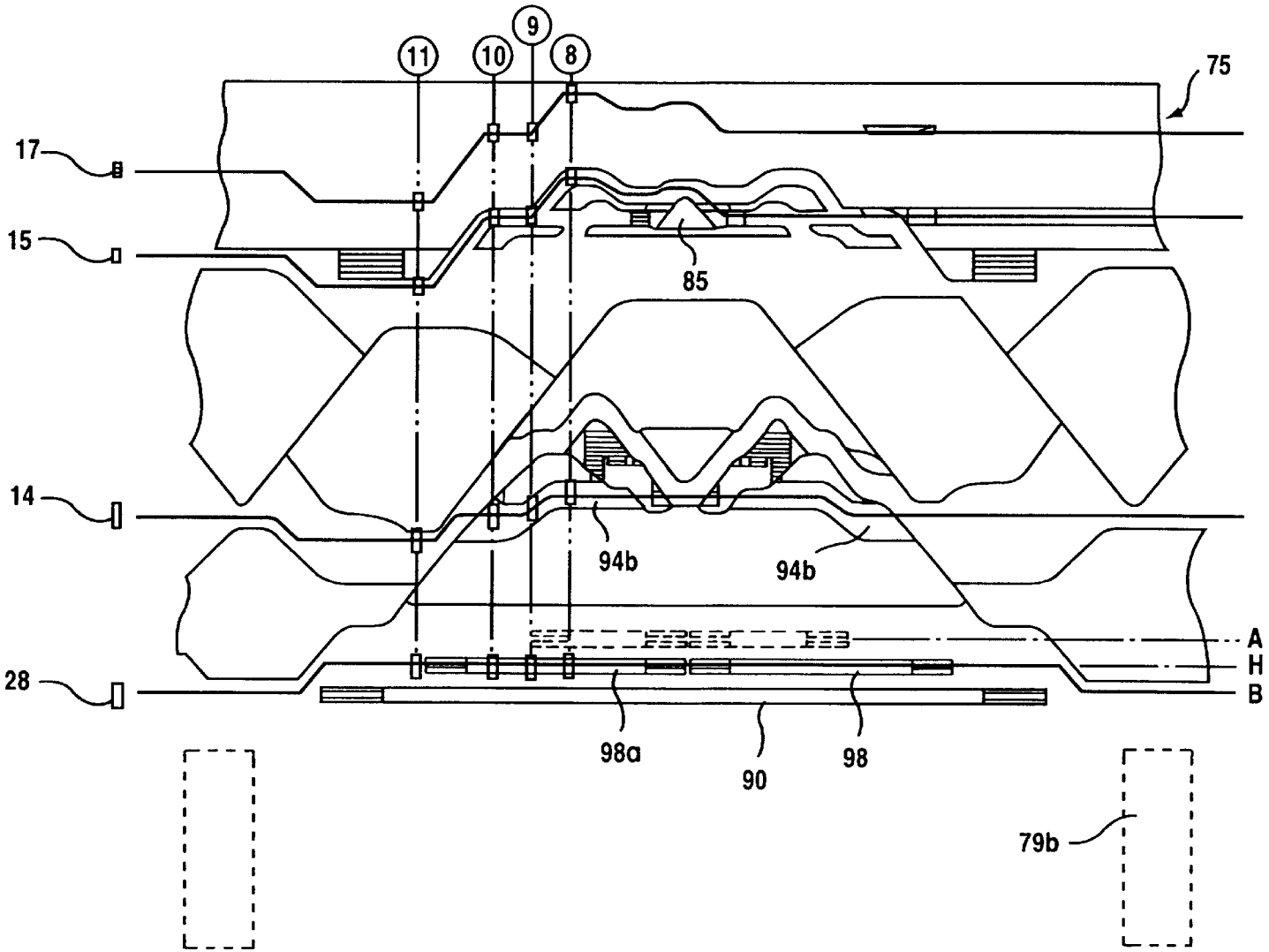
FIG. 9 is a diagram showing the passage routes of the respective butts and cam actions at the positions 8 through 11 of the trailing cam lock at the time of split knit.

After that, the carriage reverses to the right and travels, and the respective butts take the routes shown in FIG. 9. In the travel to the right, the leading and trailing H-pressers 98*a*, 98*b* and the first transfer control cam 85 operate. Only needles for split knit are set in the H-position by the selector 79*b*. The needle proper butt 14 is guided through the part 94*b* of the half height of the raising cam 94, and the second butt 15 of the slider 5 takes the route of transferring of transfer. A needle of the opposing needle bed, which responds to split knit, takes the route of receiving of transfer to receive the old stitch loop being held on tongues 8 of the slider 8 of the needle for split knit. Thus split knit is completed.

Next, modifications of the above guiding mechanism will be described with reference to FIG. 10 through FIG. 13. The parts that are identical to those of Embodiment 2 are denoted by the identical marks and description of these parts is omitted for convenience.

Modification 1

Figure 10:
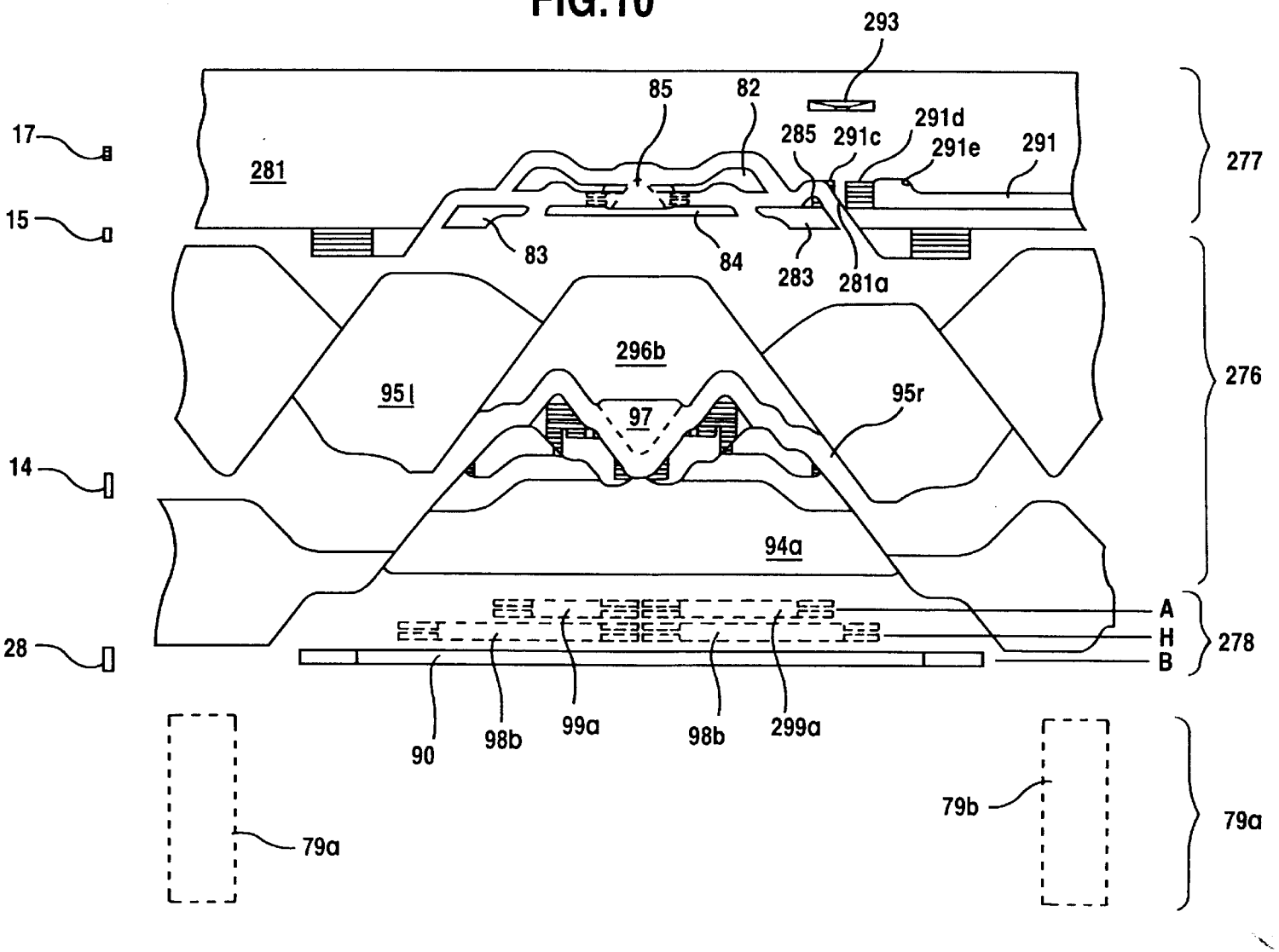
FIG. 10 is a bottom view of the cam lock showing a modification of a guiding cam.

FIG. 10 shows a modification of the guiding mechanism of cam lock shown in FIG. 6. In the embodiment of FIG. 6, to select routes for the slider 5 of the needle for knit and the slider 5 of the needle for split knit, a base of the half height is provided in the bridge cam of the needle proper cam lock. In Modification 1, a raising cam 285 of the half height is provided in the guide cam 283 of the slider cam lock 277. With this change, of the fixed slider cam 281, a portion opposing said raising cam 285 is hollowed out as shown in the diagram. This hollowed part is the passage route of the second butt of the slider 5. Further, a slope 291*c* is provided. This slope 291*c* allows the second butt being advanced by the raising cam 285 to move into the bypass groove 291. 291*d* denotes a slope that leads from the zero height of the bypass groove to the full height. 291*e* denotes a clearing cam surface that clears the second butt which is advanced by the raising cam 285. 293 denotes a split knit cam, and it engages with a recess which is formed in the slider first butt of the needle for split knit which is advanced by the raising cam 285.

The needle for knit is in the position A. Its needle proper 3 is cleared when the needle proper butt 14 is cleared by the stitch cam 95*r*. The slider 5 is cleared when its second butt engages with the clearing surface 281. The needle for split knit is in the position H and is not subjected to the action of the presser 278. As a result, the butt 14 of the needle proper 3 is cleared, like the needle for knit, by the stitch cam 95*r*. This clearing of the needle proper by the stitch cam 95*r* is made when the second butt of the slider 5 engages with the raising cam 285 and advances and the first butt is in engagement with the split knit cam 293. Because of this, the slider 5 can be prevented from being cleared together with the needle proper, and the second butt of the slider 5 can be guided into the bypass groove 291 and sent to the following cam lock.

In the presser 278, the width of the A-presser 299*a* being located on the above route selection point is formed to be somewhat longer than that of the former embodiment. This presser 299*a* operates at the time of split knit, presses the select jack butt 28 of the needle for knit being set in the position A, sinks the second butt of the slider 5 and makes the second butt go through without engagement with the raising cam 285.

Figure 8:
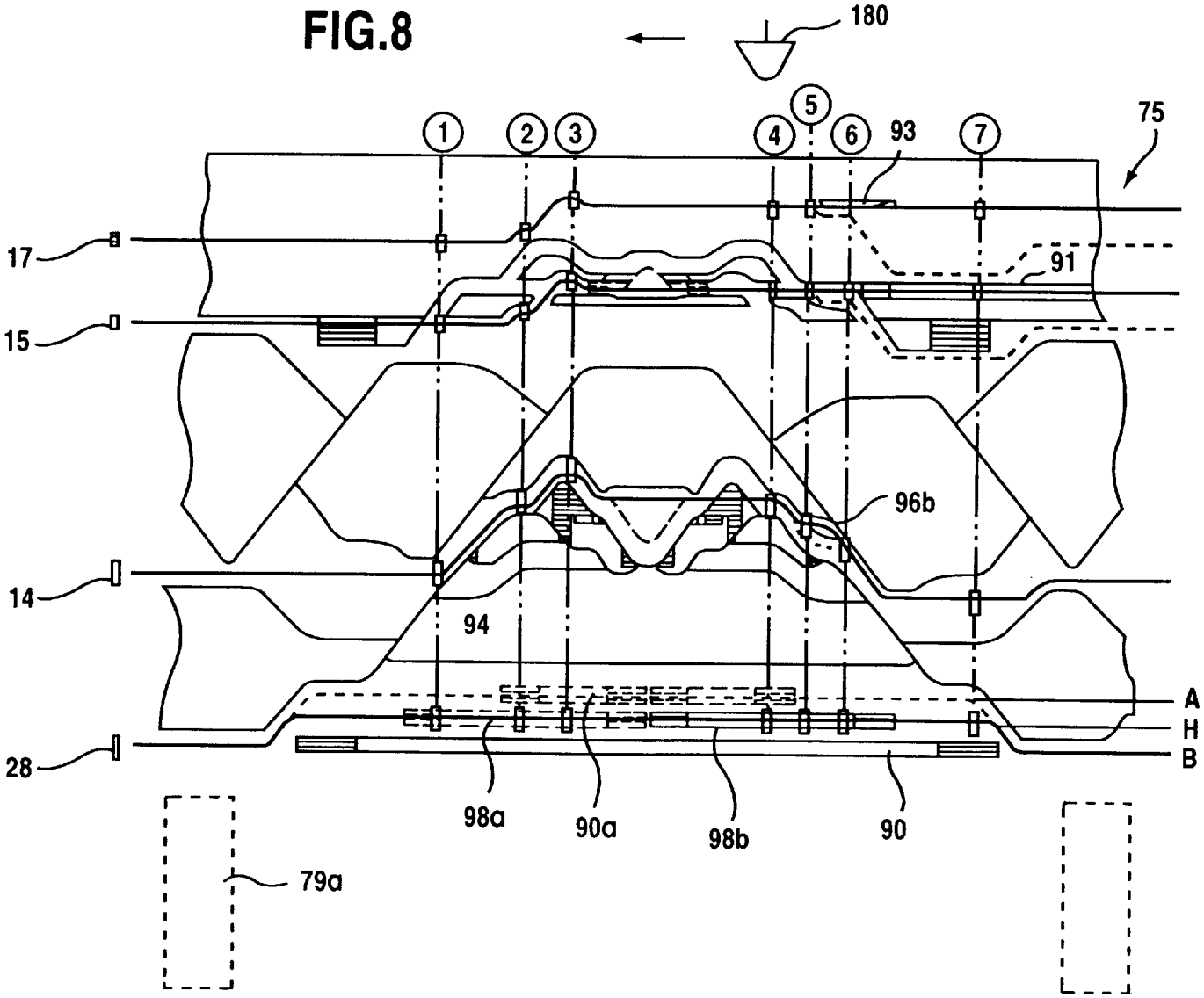
FIG. 8 is a diagram showing the passage routes of the respective butts and cam actions at the positions 1 through 7 of the leading cam lock at the time of split knit.
Figure 11:
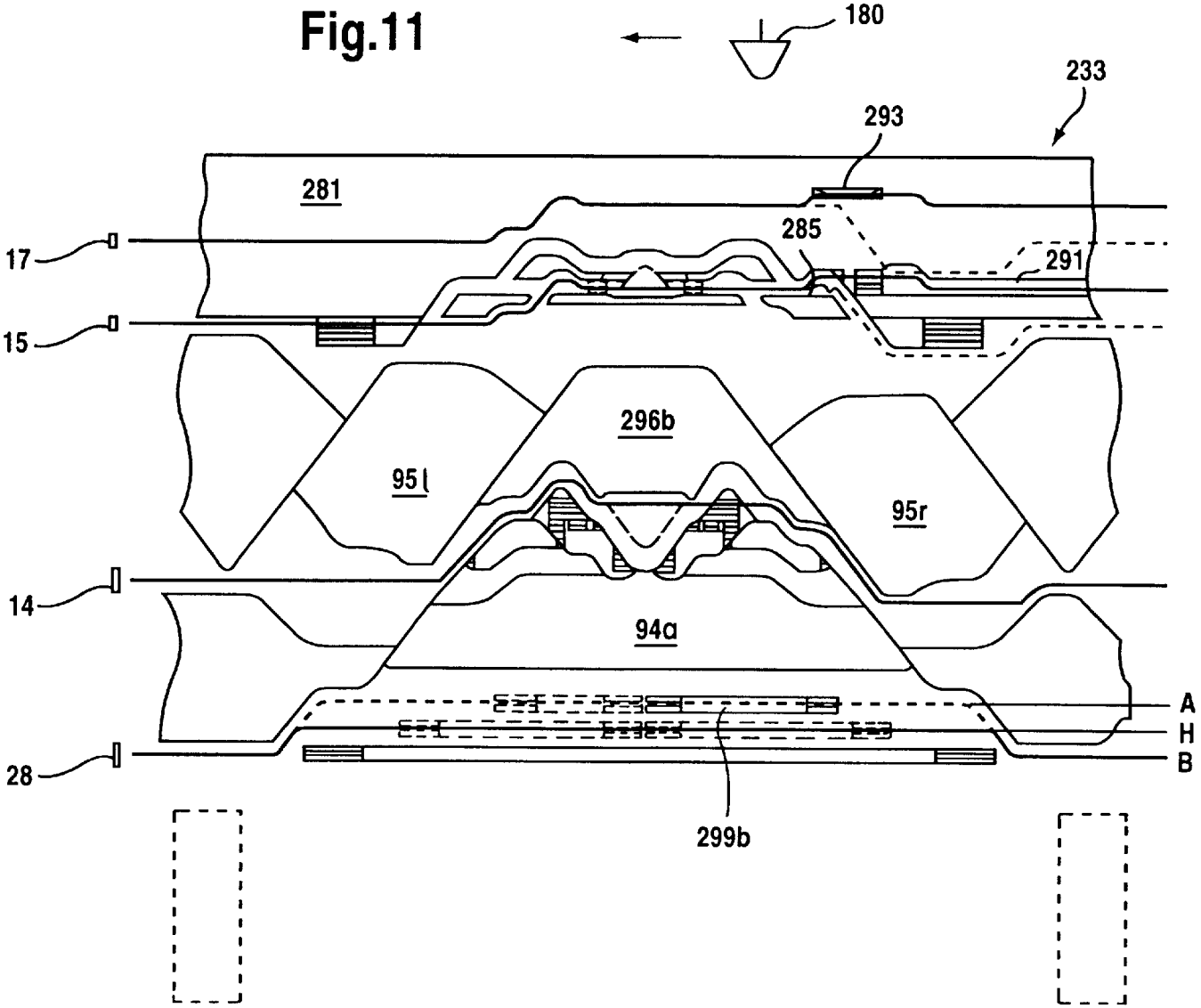
FIG. 11 is a diagram showing the passage routes of the respective butts and cam actions in the leading cam lock at the time of split knit in the modification.

FIG. 11 corresponds to FIG. 8 and shows the passage routes of the respective butts and cam actions of the leading cam lock at the time of split knit. Full line indicates the routes of the respective butts for split knit. Dashed line indicates the routes for knit, being portions differing from those for split knit.

Modification 2

Figure 12:
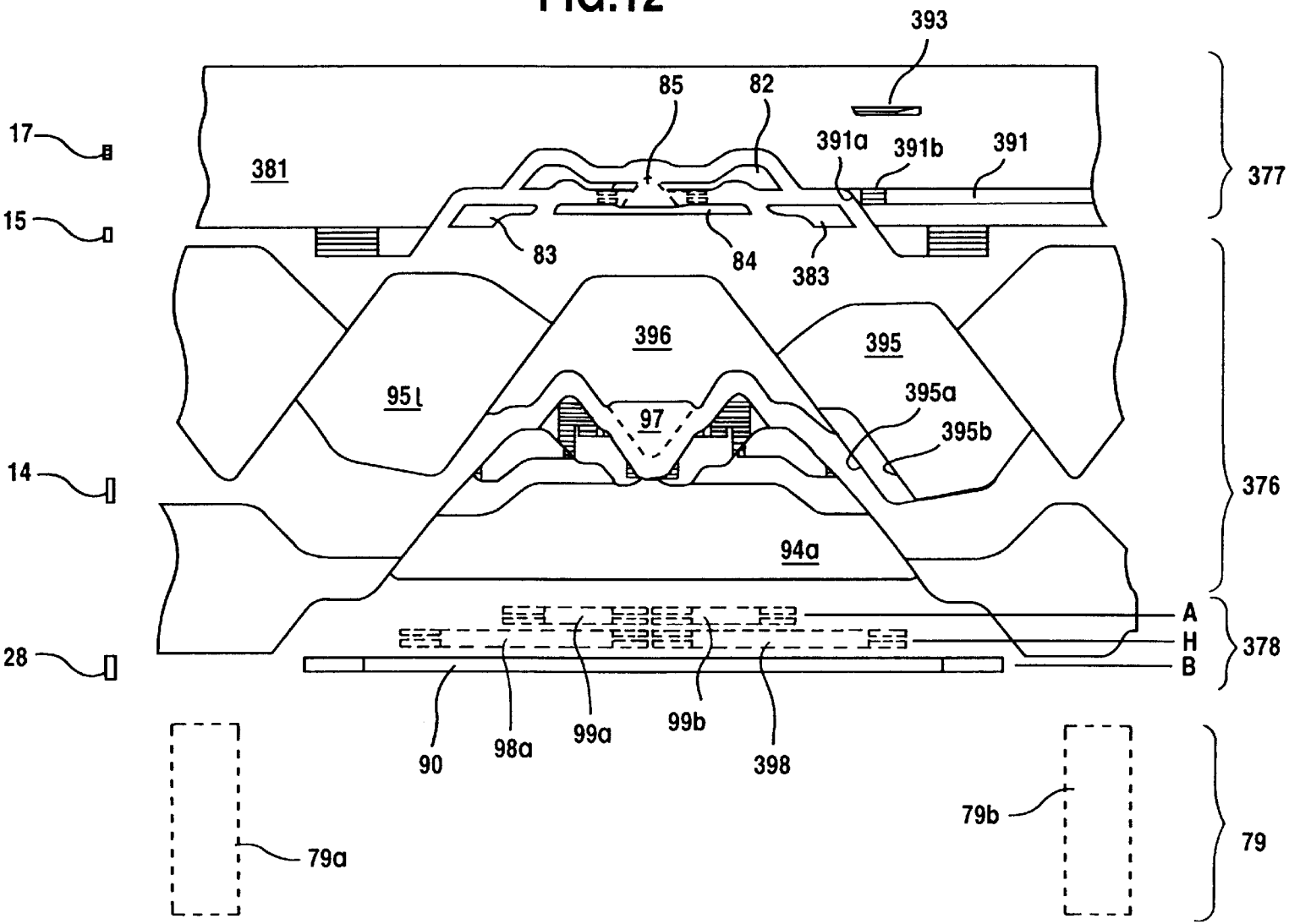
FIG. 12 is a bottom view of the cam lock showing the second modification of the guiding cam.

FIG. 12 shows another modification of the guiding mechanism of the cam lock of FIG. 6. In Modification 2, route selection for the slider 5 of the needle for knit and for the slider 5 of the needle for split knit is made by the stitch cam 395 provided in the needle proper cam lock and the split knit presser 398 provided in the presser 378.

The stitch cam 395 comprises the first clearing surface 395*a* of the half height and the second clearing surface 395*b* of the full height. The second surface 395*b* is on the trailing side of the first surface 395*a*. The H-presser 398 is a presser of which pressing length is one half and guides the second butt of the slider 5 to said split knit bypass route 391. 391*a* of the bypass route has the half height, and 391*b* denotes a slope connecting the half height and the zero height.

The needle for knit is in the position A, and the needle proper 3 is cleared by engagement of the needle proper butt 14 with the first clearing surface 395*a* of the stitch cam 395. The slider is cleared by engagement of the second butt with the clearing surface 391*a* of the half height of the bypass groove 391. The needle for split knit is in the position H. Due to suppression by the H-presser 398*b*, the butt 14 of the needle proper 3 does not engage with the first clearing surface 395*a* of the stitch cam 395. While the needle proper 3 is moving horizontally without being cleared, the recess of the first butt of the slider 5 and the split knit cam 393 are made to engage with each other. At the time of this engagement, the needle proper 3 is cleared by the second clearing surface 395*b* of the stitch cam 395, inadvertent movement of the slider 5 is prevented, and the second butt of the slider 5 is made to pass through the bypass groove 391 and guided to the subsequent cam lock.

Figure 13:
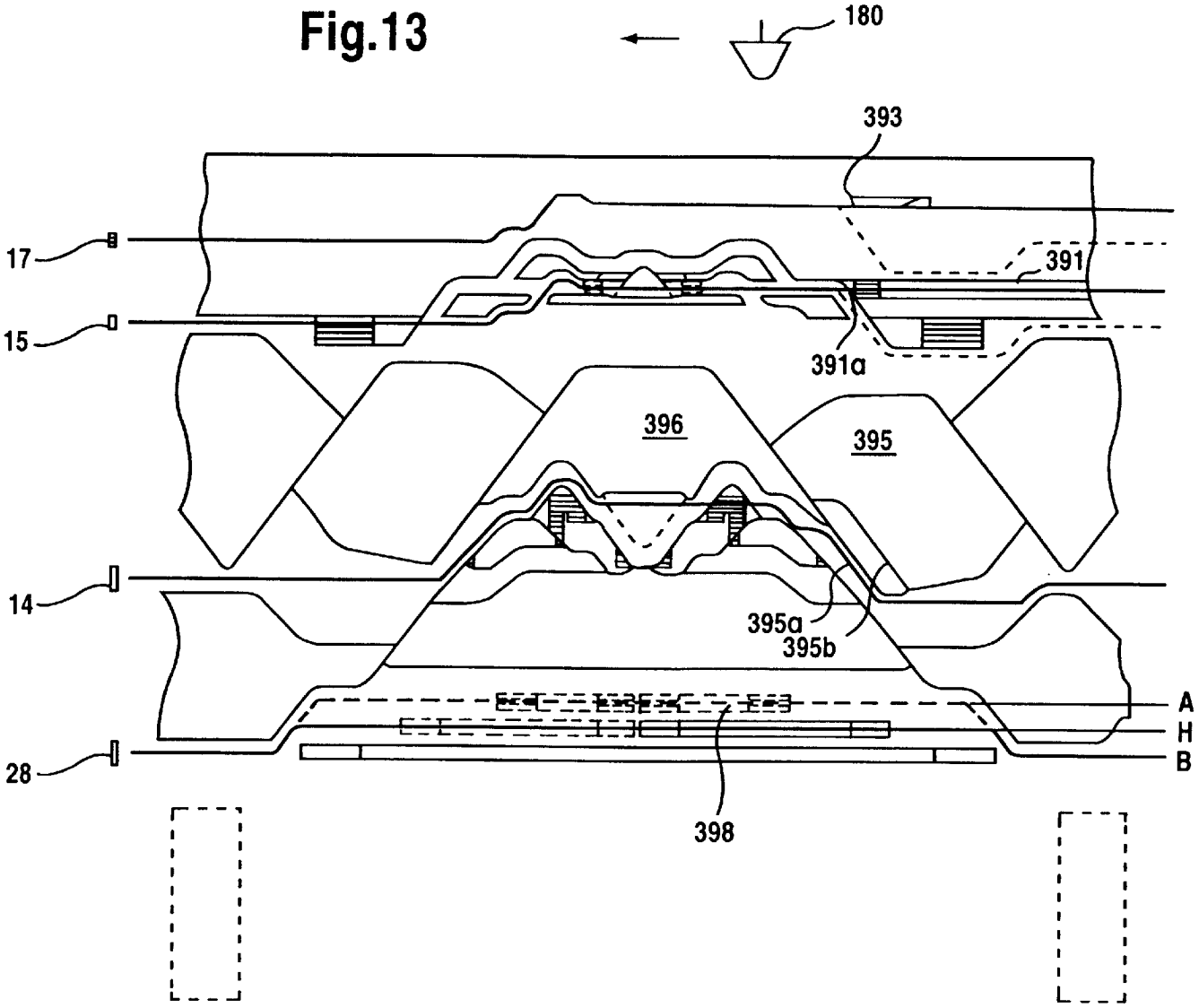
FIG. 13 is a diagram showing the passage routes of the respective butts and cam actions in the leading cam lock at the time of split knit in the second modification.
Figure 14:
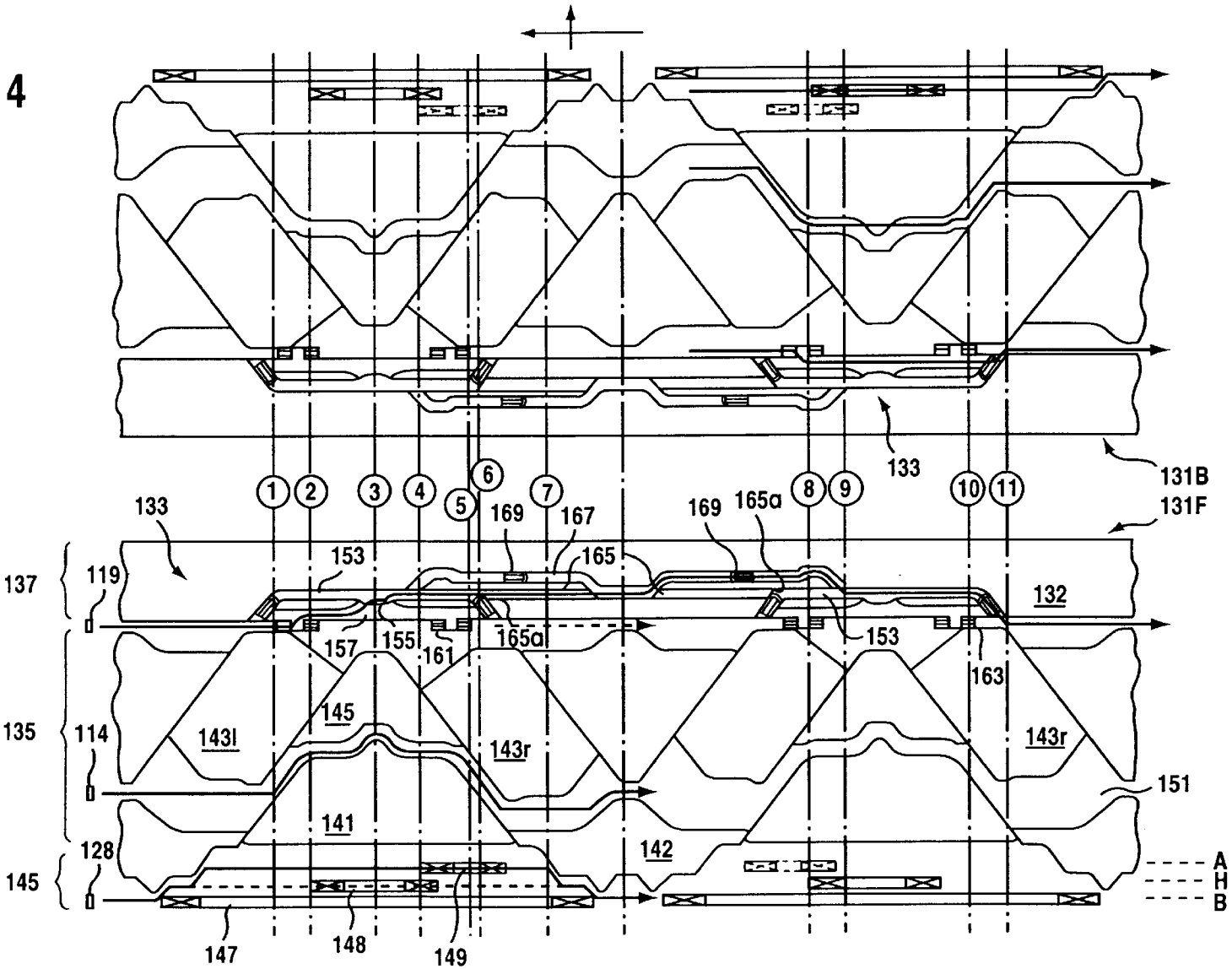
FIG. 14 is a diagram showing the cam lock and the passage routes of the respective butts provided on needles at the time of split knit when the slider does not make inadvertent movement.
Figure 15:
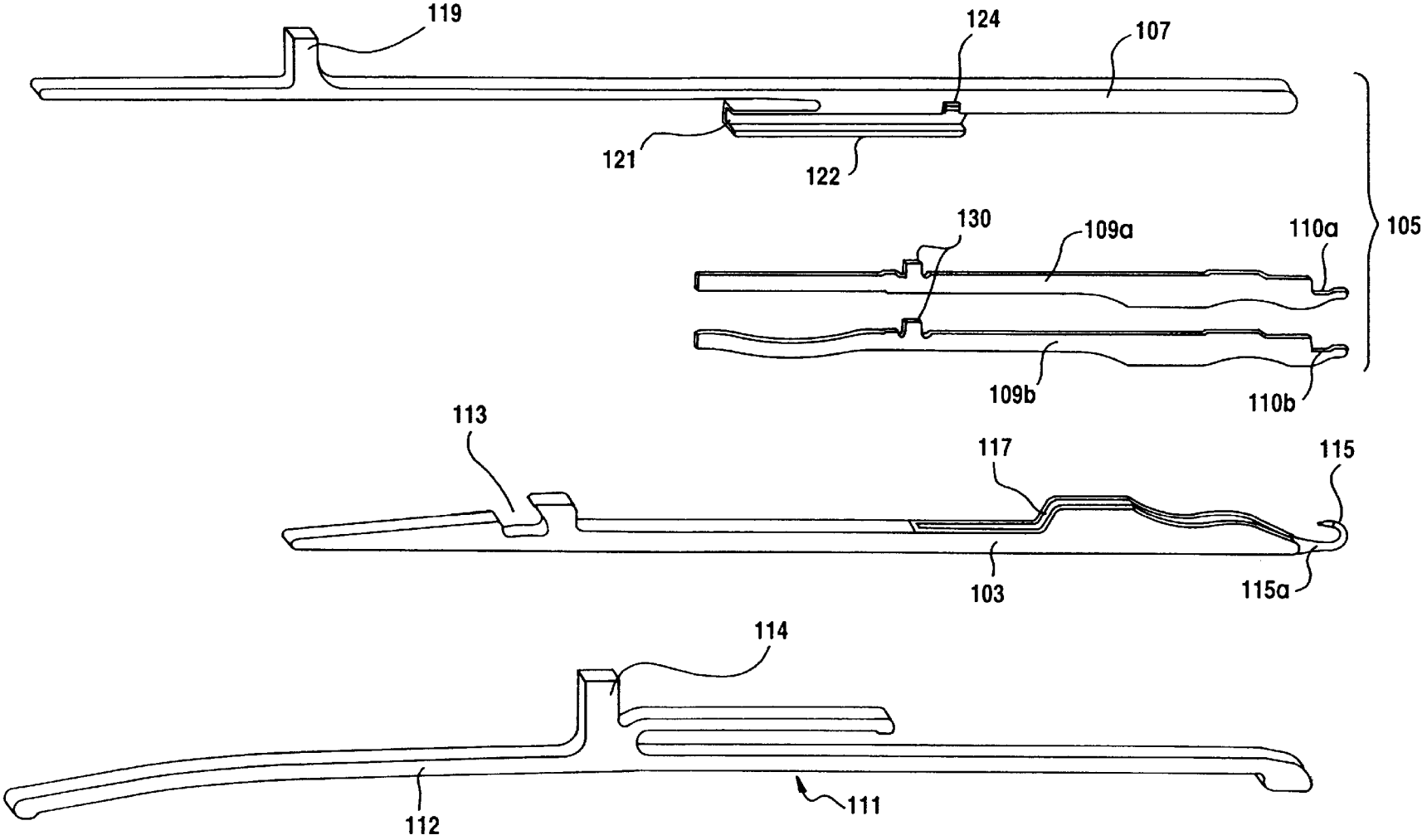
FIG. 15 is a perspective view of the respective parts constituting the needle.
Figure 16A:
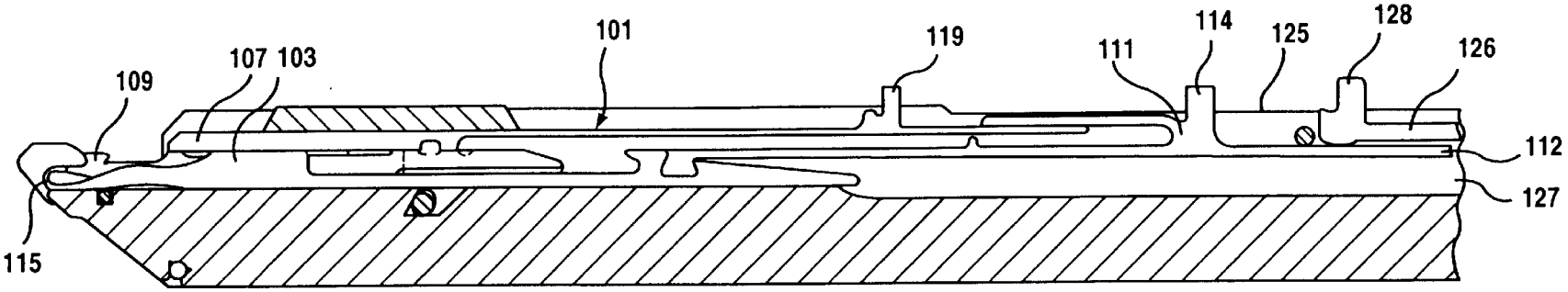
FIG.16a PRIOR ART
FIG. 16 is a sectional view of the head of a needle bed of prior art.
Figure 16B:
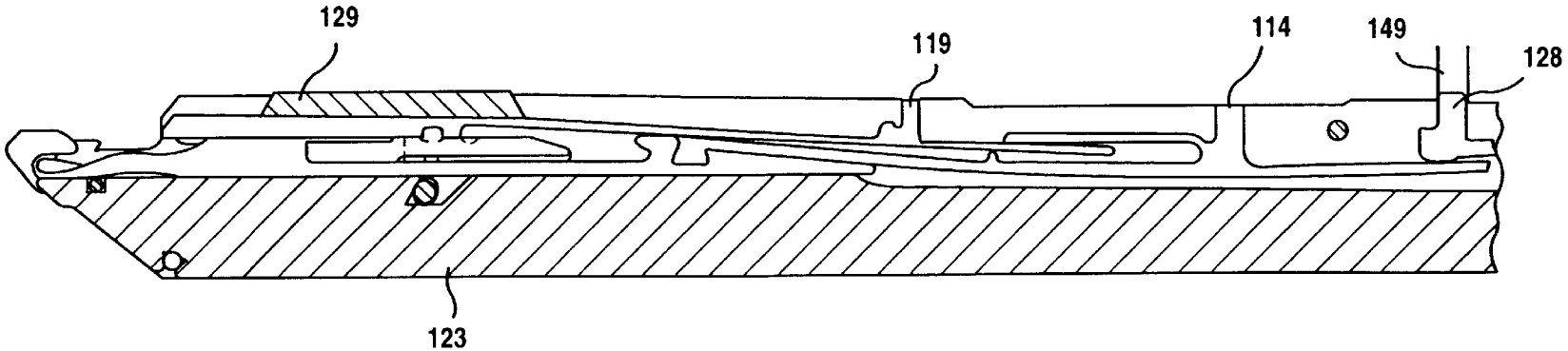
FIG.16b PRIOR ART

FIG. 13 corresponds to FIG. 8 and shows the passage routes of the respective butts and cam actions of the leading cam lock at the time of split knit. Full line indicates the routes of the respective butts for split knit. Dashed line indicates the routes for knit, being portions differing from those for split knit.

Preferred embodiments have been described. The present invention is not limited to these embodiments described above and can be modified in various ways. For instance, in the embodiment, the top surface of the first butt of the slider is formed to be concave, and the tip of the split knit cam which is to be fitted with the recess is formed to be convex. This concave-convex relationship may be reversed. Fitting is not essential. It is sufficient that the slider can be prevented from being cleared due to retraction of the needle proper before the second butt of the slider is guided to the cam groove of the route for split knit. For example, it may be sufficient to simply provide a cam surface that engages with the rear edge of the first butt of the slider.

What is claimed is:

1. A flat knitting machine comprising:

at least two needle beds each having needle grooves and arranged to oppose each other, one in front and the other in rear, with a trick gap between them;

compound needles arranged in said needle grooves, each having a slider including two blades and a tongue formed in the head thereof, a needle proper with a hook formed in the head thereof, and a select jack, wherein said compound needles open and close the hook by relative movement of the slider and the needle proper, and said tongue of the slider is capable of advancing beyond the hook;

wherein a needle proper butt is protrusively provided on the top face of each needle proper; and an elastic foot is provided in the rear of the needle proper to make the needle proper butt sinkable in the needle groove;

wherein each slider is held on the needle proper; and a first butt located on the front side and a second butt behind the first butt are protrusively provided on the top face of the slider;

and wherein each select jack is arranged in the rear of and above the needle proper; a select jack butt is protrusively provided on the top face of the select jack; and the select jack can change the position between an initial position and an advanced position;

a carriage reciprocating over said needle beds comprising:

a needle proper cam lock including a bridge cam, a stitch cam and a raising cam, each contacting said needle proper butt to advance and retract the needle proper;

a slider cam lock including a guide cam contacting said second butt to advance and retract the slider; and a presser system being capable of selectively press said select jack butt in such a way that said needle proper butt and said second butt are made sinkable into the needle groove by the presser system;

said carriage further comprising for split knit:

a split knit bypass route guiding the second butt of the slider to the trailing cam lock while the slider is kept in a position into which the slider is advanced by the slider cam lock; and a split knit cam preventing the second butt of said slider from leaving the split knit bypass route; each provided in said slider cam lock;

and a guiding means for guiding the first butt of the slider to engage with said split knit cam.

2. A flat knitting machine of claim 1, wherein said guiding means comprises a split knit presser of half height for halfly sinking said select jack butt into the needle groove, and a base of half height extending from at least one end of said bridge cam, engaging with a needle proper butt of a compound needle of which select jack is not sunk and not engaging with a needle proper butt of a compound needle of which select jack is halfly sunk.

3. A flat knitting machine of claim 1, wherein said guiding means comprises a raising cam of half height provided in the slider cam lock, on the leading side of said split knit cam, engaging with the second butt and advancing the first butt to a position at which the first butt engages with said split knit cam; and a split knit presser of half height for halfly sinking said select jack butt into the needle groove.

4. A flat knitting machine of claim 1, wherein said guiding means comprises a first clearing surface of half height provided on said stitch cam; a second clearing surface of full height provided on the trailing side of the first clearing surface and guiding said second butt to said split knit bypass route; and a split knit presser of half height for halfly sinking said select jack butt into the needle groove.

5. A flat knitting machine of claim 1, wherein each of said slider cam lock and said needle proper cam lock is provided, in addition to stitch loop forming routes of knit, tuck and miss, with a stitch loop transfer route.

* * * * *